US006324374B1

(12) United States Patent
Sasamoto et al.

(10) Patent No.: US 6,324,374 B1
(45) Date of Patent: Nov. 27, 2001

(54) BELT DEVICE AND UNIT DEVICE INCLUDING BELT DEVICE AND IMAGE FORMING APPARATUS USING THE BELT DEVICE AND UNIT DEVICE

(75) Inventors: Tetsurou Sasamoto; Katsuaki Miyawaki; Makoto Obu; Minoru Suzuki, all of Yokohama; Yuichi Aoyama, Tokyo, all of (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/584,153

(22) Filed: May 31, 2000

(30) Foreign Application Priority Data

| | | |
|---|---|---|
| Jun. 14, 1999 | (JP) | 11-166288 |
| Dec. 22, 1999 | (JP) | 11-365318 |
| Apr. 14, 2000 | (JP) | 12-114451 |

(51) Int. Cl.[7] ..... G03G 15/16

(52) U.S. Cl. ..... 399/298; 399/82; 399/101; 399/302

(58) Field of Search ..... 399/71, 82, 85, 399/298, 299, 302, 101, 38

(56) References Cited

U.S. PATENT DOCUMENTS

| | | | | |
|---|---|---|---|---|
| 5,156,308 | | 10/1992 | Aoyama | 222/145 |
| 5,248,847 | | 9/1993 | Aoyama | 399/238 |
| 5,652,080 | | 7/1997 | Yoshino et al. | 430/119 |
| 5,652,948 | * | 7/1997 | Sakaguchi et al. | 399/302 X |
| 5,666,616 | | 9/1997 | Yoshino et al. | 399/240 |
| 5,678,149 | * | 10/1997 | Takekoshi et al. | 399/299 |
| 5,708,938 | | 1/1998 | Takeuchi et al. | 399/250 |
| 5,765,082 | * | 6/1998 | Numazu et al. | 399/299 |
| 5,923,930 | | 7/1999 | Tsukamoto et al. | 399/237 |
| 5,953,559 | | 9/1999 | Obu | 399/110 |
| 5,987,281 | | 11/1999 | Kurotori et al. | 399/237 |
| 5,987,282 | | 11/1999 | Tsukamoto et al. | 399/237 |
| 5,987,291 | * | 11/1999 | Masuda | 399/302 |
| 6,021,287 | * | 2/2000 | Tanaka | 399/299 X |
| 6,029,023 | * | 2/2000 | Munemori et al. | 399/82 X |
| 6,038,421 | | 3/2000 | Yoshino et al. | 399/239 |
| 6,061,542 | * | 5/2000 | Minami et al. | 399/299 |
| 6,134,402 | * | 10/2000 | Nakayama et al. | 399/101 |
| 6,192,007 | * | 2/2001 | Yamamoto et al. | 399/82 |

FOREIGN PATENT DOCUMENTS

| | | |
|---|---|---|
| 59-192159 U | 12/1984 | (JP) . |
| 08160839 A | 9/1996 | (JP) . |
| 09146383 A | 6/1997 | (JP) . |

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus suppresses several kinds of inconveniences caused by unnecessary contact of a belt-formed member with opposing members and drives the belt-formed member accurately even when the belt-formed member separated from a part of a plurality of opposing members. In an image forming apparatus having a belt-formed member supported by a plurality of supporting rollers and a plurality of opposing members located side by side in a line to oppose and contact the belt-formed member, a pivot mechanism is employed to temporarily separate the belt-formed member from a part of the opposing members for color image formation. The image forming apparatus also includes a tension roller dive mechanism to increase a relative distance between the tension roller and other supporting rollers to suppress a decrease in a tension of the belt-formed member during the above-described separation of the belt-formed member from the plurality of opposing members.

16 Claims, 25 Drawing Sheets

BELT DEVICE AND UNIT DEVICE INCLUDING BELT DEVICE AND IMAGE FORMING APPARATUS USING THE BELT DEVICE AND UNIT DEVICE

CROSS-REFERENCE TO RELATED APPLICATIONS

This document claims priority and contains subject matter related to Japanese Patent Applications Nos. JPAP11-166288 filed on Jun. 14, 1999, JPAP11-365318 filed on Dec. 22, 1999 and JPAP2000-114451 filed on Apr. 14, 2000, and the entire contents thereof are herein incorporated by reference.

BACKGROUND OF THE INVENTION

1. Field of the Invention

The present invention relates to an image forming apparatus such as, a copying machine, a facsimile, a printer, etc., and more particularly to an image forming unit device including a belt-formed member and a belt device in which the belt-formed member drives accurately even when the belt-formed member temporarily separates from some of opposing members.

2. Discussion of the Background

As an image forming apparatus, a tandem multicolor image forming apparatus, that includes an intermediate transfer element supported by a plurality of supporting rollers and a plurality of photoconductive elements as opposing members (image bearing members) arranged side by side in a line opposite to the intermediate transfer element and contacting the intermediate transfer element is known (e.g. in Japanese Utility Model Laid-Open No. 59-192159 and Japanese Patent Laid-Open publication No. 8-160839). In the apparatus, visible images corresponding to respective colors formed on surfaces of respective photoconductive elements are transferred onto the intermediate transfer element one after another while being superimposed with each other (a primary transfer). The visible image thus formed on the intermediate transfer element is then transferred onto a transfer member a t one time (a secondary transfer) to form a multicolor image on the transfer member. In those multicolor image forming apparatuses, there are apparatuses configured such that a black and white image forming mode using a single photoconductive element and a multicolor image forming mode superimposing toner images of a plurality of colors with each other using a plurality of photoconductive elements are selectable.

FIG. 27 illustrates a fullcolor electrophotographic copying machine using liquid developer as an example of the above-described tandem multicolor image forming apparatus. In the apparatus, four drum-shaped photoconductive elements 501Y, 501M, 501C and 501B corresponding to respective colors of yellow Y, magenta M, cyan C and black BK are provided side by side in a line such that the axes of rotation of photoconductive elements are located in parallel and in the same plane. Around respective photoconductive elements 501Y, 501M, 501C and 501B rotating in a clockwise direction, charging devices, writing systems to form an electrostatic image by irradiation of beam light corresponding to respective colors, developing units with liquid developer for respective colors etc. (not shown) are provided respectively in an order of a liquid electrophotographic printing process. Further, an intermediate transfer belt 505 as an intermediate transfer member is supported by a tension roller 502, guide rollers 503 and 504 etc. so as to rotate in a counterclockwise direction. The intermediate transfer belt

505 is disposed so as to contact each primary transfer area of photoconductive elements 501Y, 501M, 501C and 501B. The intermediate transfer belt 505 is pressed by spanning rollers 506Y, 506M, 506C and 506B so that it windingly contacts respective photoconductive elements. An image on the intermediate transfer belt 505, which has been formed as a result of transferring images of respective colors (Y, M, C and BK) at the primary transfer areas of respective photoconductive elements 501Y, 501M, 501C and 501B superimposing one after another, is conveyed to a secondary transfer area where a portion of the intermediate transfer belt 505 spanned between guide rollers 503 and 504 contacts a secondary transfer roller 507. Then, the image is transferred onto a transfer sheet 508 at the secondary transfer area to form a multicolor image on the transfer sheet 508. Further, a cleaning device 509 is provided at a place where the intermediate transfer belt 505 is supported by the tension roller 502.

In the fullcolor electrophotographic copying machine with liquid developer, a color mode can be freely selected from among, for example, a single color mode and a multicolor mode with four colors (a full color mode), two colors or three colors. For example, when a single color mode (black color mode) is selected, a black color image is formed on the transfer sheet 508 using the photoconductive element 501B, electrophotographic copying process members and the intermediate transfer belt 505.

When a single color image forming operation is performed in the above-described electrophotographic copying machine having selectable single color and multicolor modes, inconveniences may be caused because the photoconductive elements which are not involved in the image forming operation are located in contact with or in close proximity to the intermediate transfer element.

For example, life times of the photoconductive elements may be decreased because the photoconductive elements are kept in contact with the intermediate transfer element even when the photoconductive elements are not involved in the image forming operation. In the apparatus illustrated in FIG. 27, even in the black color mode, photoconductive elements 501Y, 501M and 501C, which are not involved in the image forming operation, are kept in contact with the intermediate transfer belt 505 and are rubbed by it. Therefore the life times of these photoconductive elements may be decreased.

Further, when photoconductive elements which are not involved in the image forming operation are kept in contact with or in close proximity to the intermediate transfer element, developer remaining on the photoconductive elements may be flown by the intermediate transfer element and scattered inside the apparatus. Developer remaining on the photoconductive elements may also adhere to a surface of the intermediate transfer element, which results in unnecessary consumption of developer.

The above-described inconveniences such as the life times of opposing members, such as photoconductive elements being decreased due to unnecessary contact of a belt-formed member, such as the intermediate transfer element, with the opposing members are caused not only in the above-described exemplary construction where a plurality of photoconductive elements are located side by side in a line so as to oppose and contact the belt-formed intermediate transfer element, but also in a construction where a plurality of opposing members are disposed side by side in a line so as to oppose and contact a belt-formed member supported by a plurality of supporting rollers driven while being temporarily separated from part of the plurality of opposing members. The above-described inconveniences are also caused, for example, in a construction where a belt-formed photoconductive element drives while the belt-formed photoconductive element is temporarily separated from part of a plurality of developer bearing members as the plurality of opposing members, or in a construction where a belt-formed transfer sheet conveying member drives while the belt-formed transfer sheet conveying member is temporarily separated from part of a plurality of photoconductive elements as the plurality of opposing members. Further, the above-described scattering of developer and unnecessary consumption of the developer occur not only when the plurality of opposing members are located side by side in a line opposing and contacting the belt-formed member but also when the plurality of opposing members are located side by side in a line opposing the belt-formed member in close proximity.

For example, in Japanese Patent Laid-Open Publication No. 9-146383, an example of an image forming apparatus, configured such that a transfer sheet conveying belt partly moves to separate from three photoconductive elements out of four, is described.

The inventors discovered the following shortcoming as a result of a further study on a construction that enables the intermediate transfer element as the belt-formed member to separate from part of the plurality of photoconductive elements as the plurality of opposing members. When the intermediate transfer element is separated from part of the photoconductive elements that are not involved in the image forming operation, a tension of the intermediate transfer element may vary. For example, when the intermediate transfer element is configured to contact each of the photoconductive elements with a certain contacting angle in order to form a primary transfer nip of a required width between the intermediate transfer element and each photoconductive element, the tension of the intermediate transfer element may be decreased when the intermediate transfer element is separated from some of the photoconductive elements which are not in use. Further, when part of a plurality of supporting rollers pivot in order to separate the intermediate transfer element from part of the photoconductive elements which are not involved in the image forming operation, the tension of the intermediate transfer element may be decreased or increased depending on a position of a pivot.

When the intermediate transfer element is driven while the tension has varied, the intermediate transfer element may not be driven accurately. For example, when the intermediate transfer element is frictionally driven by rubber rollers, if the tension of the intermediate transfer element is decreased, the intermediate transfer element may not be accurately driven by the rubber rollers due to slides of the intermediate transfer element over the rubber rollers. Contrarily, if its tension is increased, a driving load imposed on the intermediate transfer element may become too excessive to drive the intermediate transfer element accurately. What is meant herein by saying that the intermediate transfer belt is driven accurately is to minimize a change in the speed of the intermediate transfer element.

The above-described inconvenience of inaccurate drive of a belt-formed intermediate transfer element due to a variation in the tension of the intermediate transfer element may be caused not only when a plurality of photoconductive elements are disposed side by side in a line opposing and contacting the belt-formed intermediate transfer element as described above, but also when a plurality of opposing members are arranged side by side in a line opposing and contacting or in close proximity to a belt-formed member supported by a plurality of supporting rollers frictionally driven while being temporarily separated from part of the plurality of opposing members. For example, the inconvenience may also be caused when a belt-formed photoconductive element is driven while being separated from part of a plurality of developer bearing members as a plurality of opposing members or when a belt-formed transfer sheet conveying member is driven while being temporarily separated from part of a plurality of photoconductive elements as a plurality of opposing members. Further, the inconvenience may also be caused not only when the plurality of opposing members are arranged side by side in a line so as to contact the belt-formed member but also when they are arranged side by side in a line so as to oppose the belt-formed member in close proximity.

SUMMARY OF THE INVENTION

The present invention has been made in view of the above-discussed and other problems and addresses the above-discussed and other problems.

The present invention advantageously provides a novel image forming apparatus, an image forming unit device having a belt-formed member and a belt device for use in the image forming apparatus, for preventing inconveniences caused by unnecessary contact of the belt-formed member with opposing members, or proximity of the two members by making it possible to separate the belt-formed member from part of the opposing members.

The present invention also advantageously provides a novel image forming apparatus, an image forming unit device having a belt-formed member and a belt device for use in the image forming apparatus, for driving the belt-formed member accurately even when the belt-formed member is separated from part of a plurality of opposing members located in close proximity to the belt-formed member or contacting the belt-formed member.

According to an embodiment of the present invention, an image forming apparatus includes a belt-formed member supported by a plurality of supporting rollers, the belt-formed member being a belt-formed intermediate transfer element, a plurality of opposing members located side by side in a line and opposing said belt-formed member, each of the plurality of opposing members being a latent image bearing member to form a latent image to be transferred onto the intermediate transfer element and a separation device to separate the intermediate transfer element located in close proximity to the plurality of latent image bearing members or in contact with the plurality of latent image bearing members from part of the plurality of latent image bearing members.

Other objects, features and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
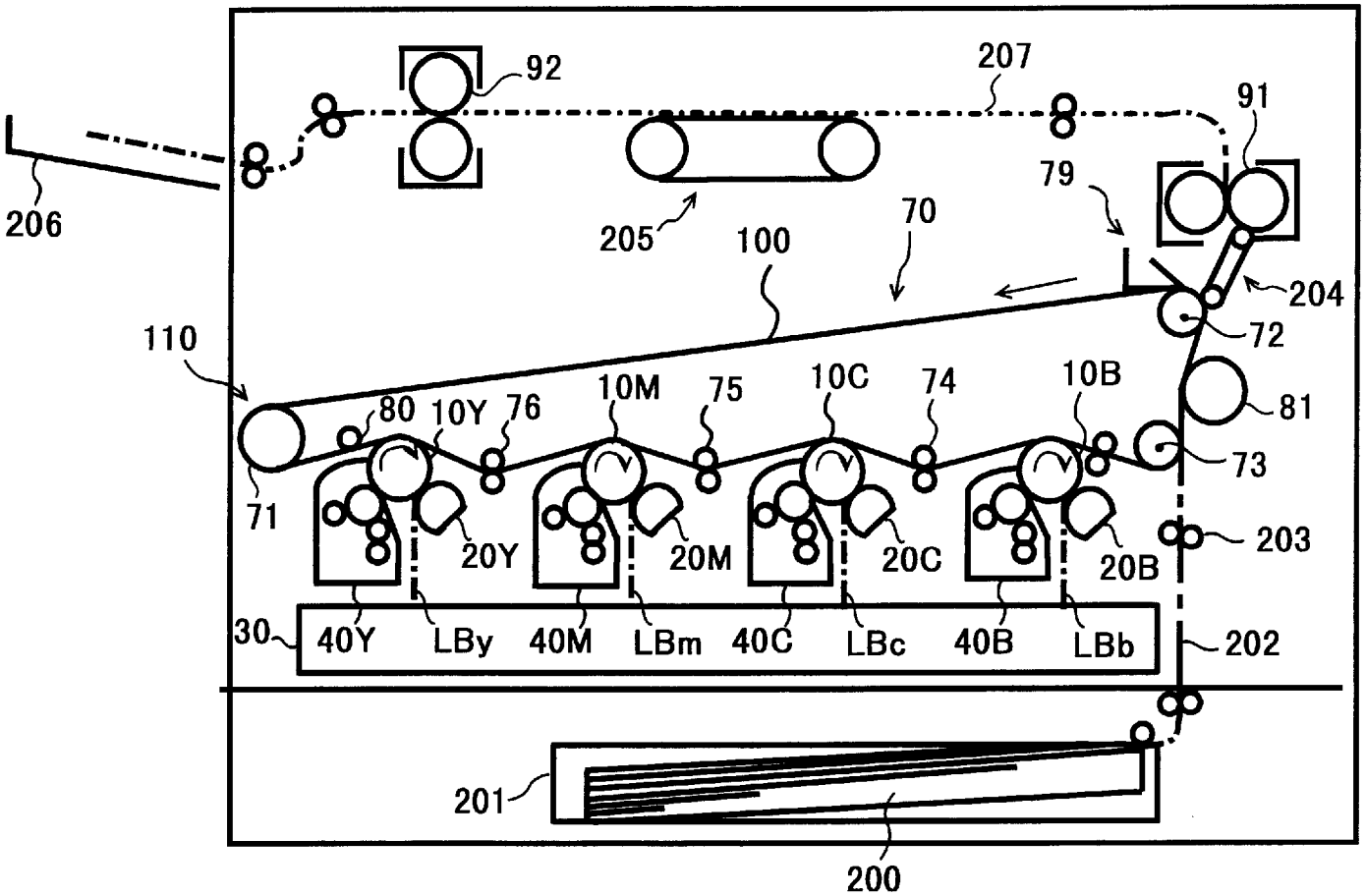
FIG. 1 is a schematic drawing illustrating an exemplary construction of a printer as an example of an image forming apparatus according to an embodiment of the present invention.

Referring now to the drawings, wherein like reference numerals designate identical or corresponding parts throughout the several views, FIG. 1 is a schematic drawing illustrating an internal construction of an electrographic multicolor printer with liquid developer (hereinafter referred to as printer) as an example of an image forming apparatus according to an embodiment of the present invention. The printer receives image data from a personal computer (PC) etc., and performs a printing process.

As illustrated in FIG. 1, four drum-shaped photoconductive elements 10Y, 10M, 10C and 10B, as opposing members (latent image bearing members), corresponding to respective colors of yellow Y, magenta M, cyan C and black B, are disposed side by side in a line. Each axis of rotation of the photoconductive elements 10Y, 10M 10C and 10B is located in the same plane and in parallel with each other axis. The photoconductive element 10B for a black color mode (single color mode) is located close to a common secondary transfer area.

Above the photoconductive elements 10Y, 10M, 10C and 10B, an intermediate transfer unit 70 is removably provided to a main body of the apparatus. The intermediate transfer unit 70 includes an intermediate transfer belt 100 in an endless form as a belt-formed member (an intermediate transfer element) supported by a plurality of rotatable supporting rollers 70–76 and 80. The intermediate transfer belt 100 is spanned around spanning roller 71–76 and 80, as supporting rollers so as to windingly contact part of respective photoconductive elements 10Y, 10M, 10C and 10B.

Primary transfer rollers (not shown) are located at positions opposite to respective photoconductive elements interposing the intermediate transfer belt 100 between those primary transfer rollers and a respective photoconductive element. A transfer bias may be applied to the primary transfer roller as necessary. In the secondary transfer area, where a toner image is transferred from the intermediate transfer belt 100 onto a transfer sheet 200, located along a sheet conveying path for the transfer sheet, a secondary transfer roller 81 is provided press-contacting the intermediate transfer belt 100 and spanned around a driving roller 72 and a guide roller 73 as supporting rollers. A transfer bias may also be applied to the secondary transfer roller 81 as necessary.

For the intermediate transfer belt 100, a belt configured to be a double layer structure may be used. A first layer including an elastic member formed on a surface side where toner image is formed and a second layer including a resin sheet on back side thereof and having a volume resistivity of $10^7$ to $10^{12}$ Ωcm may be used. For the first layer, a polyurethan rubber layer of 200 to 700 μm in thickness may be used, and as for the resin sheet layer, a polyurethan resin sheet of 100 to 500 μm in thickness and which is not stretched in a circumferential direction may be used. Further, the intermediate transfer belt 100 may include a combination of a first layer of rubber on the surface (e.g. a nitrile rubber, a urethan rubber, the Butyl-rubber and a natural rubber) and a second layer of a fiber buried rubber, or a combination of the first coated layer including a fluorine resin and the second layer of an elastic conductive element having a volume resistivity of $10^5$ to $10^9$ Ωcm, where a non-elastic core (e.g. a nylon cord and a steel cord) is extendedly buried in the circumferential direction.

For supporting rollers 71–76 and 80, a grounded conductive roller (e.g. a metal roller) may be used. As for the primary transfer roller and the secondary transfer roller 81, a columned or cylindrical-shaped conductive roller having a conductive rubber layer on its surface (e.g. a metal roller or a metal pipe) may be used. When the intermediate transfer belt 100 having a conductive layer on its underside is used, a floating state conductive roller (e.g. a metal roller) or a nonconductive roller is used for supporting rollers 72–76 and 80 other than the tension roller 71 and the primary transfer roller.

The tension roller 71 is made of a conductive roller so that the conductive layer of the intermediate transfer belt 100 has a predetermined potential by a bias voltage applied to the tension roller 71. When the transfer bias is applied to the secondary transfer roller 81, a transfer electric field is formed by the potential difference between the conductive layer of the intermediate transfer belt 100 and the secondary transfer roller 81. Around the respective photoconductive elements 10Y, 10M, 10C and 10B, electrophotographic image forming processing members, such as charging devices 20Y, 20M, 20C and 20B and developing units with liquid developer 40Y, 40M, 40C and 40B are provided in order of the image forming process. Further, light irradiating paths where laser beam light LBy, LBm, LBc, and LBb is irradiated through are also disposed around respective photoconductive elements 10Y, 10M, 10C and 10B. Because developing units with liquid developer 40Y, 40M, 40C and 40B have the same structure as to each other except containing toners of different colors, those developing units can be replaced with respect to each other.

A sheet transfer path 202 is formed to convey the transfer sheet 200 from a sheet feeding tray 201 located below photoconductive elements 10Y, 10M, 10C and 10B to the secondary transfer area. A registration roller 203 to adjust a time to feed the transfer sheet 200 is located right before, in a sheet conveying direction, a guide roller 73 which is one of the supporting rollers. A first conveying belt unit 204, a primary fixing unit 91, a secondary conveying belt unit 205, a secondary fixing unit 92, an exit tray 206, etc., are properly located along a sheet discharging path 207 at a downstream side of the secondary transfer area with respect to the transfer sheet conveying direction.

In the printer according to the embodiment of the present invention, the tension roller 71 and spanning rollers 75, 76 and 80 are pivoted about a shaft of the driving roller 72 so as to be vertically swingable. By the pivotal movement of the tension roller 71 and spanning rollers 75, 76 and 80, part of the intermediate transfer belt 100, which is an intermediate transfer element (a belt-formed member), pivots around the shaft of the driving roller 72 to vertically move. As a result, the intermediate transfer belt 100 can be positioned either at a place where the intermediate transfer belt 100 contacts all of the photoconductive elements 10Y, 10M, 10C and 10B or a separated position where the intermediate transfer belt 100 contacts only the photoconductive element 10B, separated from other photoconductive elements 10Y, 10M and 10C. The separation of the intermediate transfer belt 100 from part of photoconductive elements 10Y, 10M and 10C is achieved by a belt position change mechanism 110 that changes the positions of the tension roller 71 and spanning rollers 75, 76 and 80 through a belt uplift mechanism 111U and a belt lift down mechanism 111D illustrated in FIG. 3.

Figure 27:
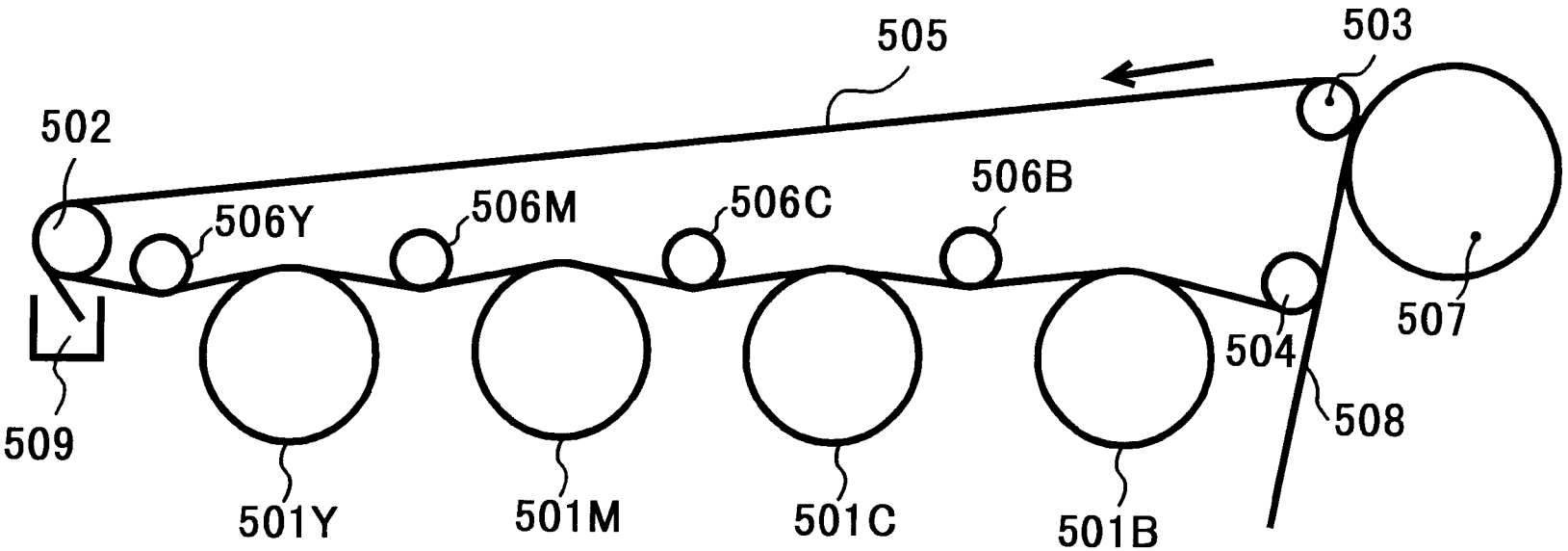
FIG. 27 PRIOR ART
FIG. 27 is an enlarged view illustrating a construction of an image forming apparatus in the art.

According to the embodiment of the present invention, a cleaning device 79 to clean the intermediate transfer belt 100 is located at the side of the pivot of the intermediate transfer belt 100 instead of a position where the cleaning device 509 is placed in FIG. 27. In other words, the cleaning device 79 is provided at a position opposed to the driving roller 72 which is the center of the pivot. Though a blade-formed cleaning device is illustrated in FIG. 1 as an example of the cleaning device 79, the cleaning device 79 may be formed like a roller, web or the like.

Figure 3:
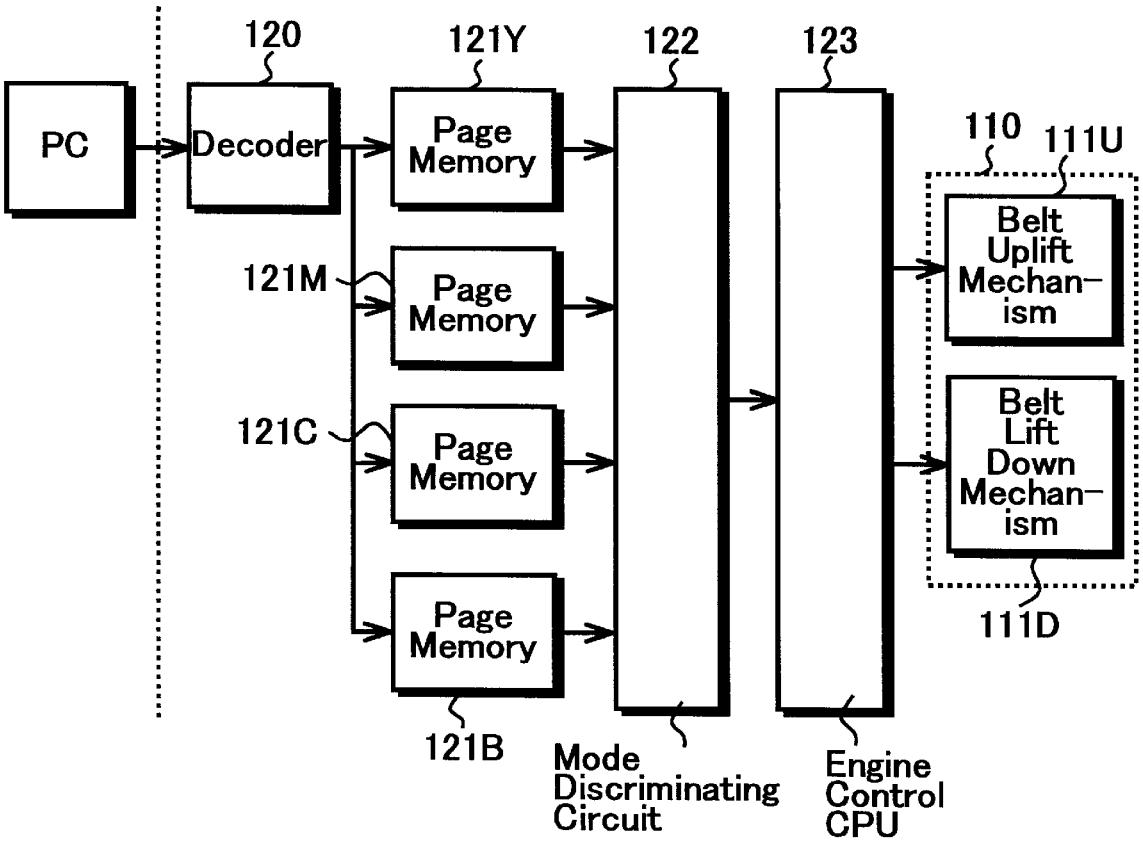
FIG. 3 is a block diagram illustrating a data processing system of the printer.

FIG. 3 is a block diagram explaining a data process control system of the printer according to the embodiment of the present invention. A decoder 120 receives image data transmitted from a personal computer (PC), converts it to image data corresponding to respective colors and then bit-maps each image data so as to be stored in page memories 121Y, 121M, 121C and 121B. A mode determination circuit 122 determines between a single color mode (black color mode) and a multicolor mode such as a full color mode based on the received image data. An engine control CPU (central processing unit) 123, which functions as a drive control device and a control device to control operations of each unit of the printer, is connected to the mode determination circuit 122.

When the mode determination circuit 122 recognizes the multicolor mode for a full color based on the image data transmitted from the personal computer PC, the engine control CPU 123 activates the belt lift down mechanism 111D. Then the belt position change mechanism 110 lifts down the tension roller 71 etc. to a position indicated by a solid line in FIG. 2 so as to contact the primary transfer areas of the photoconductive elements 10Y, 10M, 10C and 10B, which is an initial position of the intermediate transfer belt 100 (hereinafter a returning of the intermediate transfer belt to the initial position is referred to as replacement of the intermediate transfer belt). A multicolor image formation by superimposing respective color toner images on each other becomes possible by the replacement of the intermediate transfer belt 100. The replacement of the intermediate transfer belt 100 is performed while image data for the multicolor image formation is being bit-mapped and stored in respective page memories 121Y, 121M, 121C and 121B (four times longer than a time for a single color). Therefore, the apparatus can be set ready for a multicolor image forming operation without requiring an additional time for the process. Similarly, the intermediate transfer belt 100 can be cleaned several times by the cleaning device 79 by rotating the intermediate transfer belt 100 while image data for the multicolor image formation is being bit-mapped and stored in respective page memories 121Y, 121M, 121C and 121B, and thereby a cleanliness of the intermediate transfer belt 100 is increased without taking an additional time for the cleaning.

Figure 2:
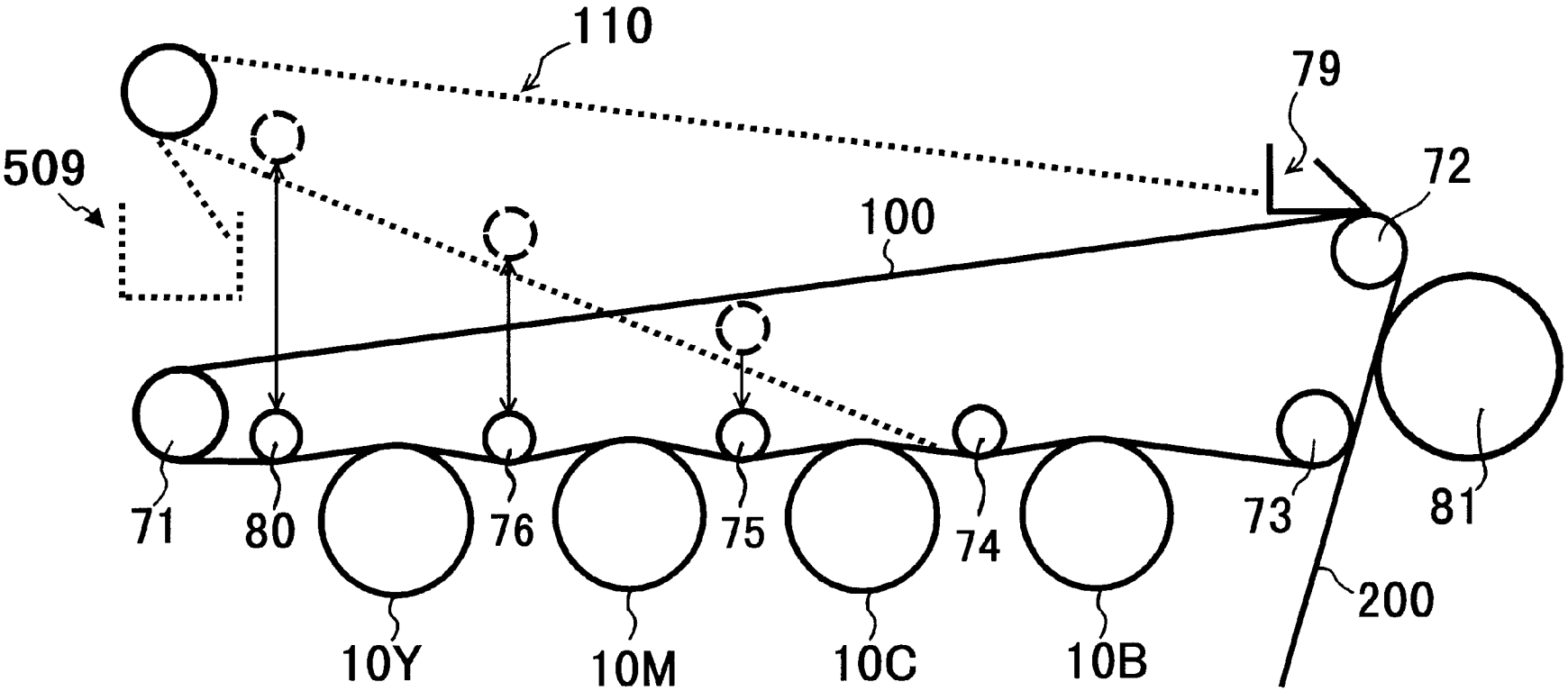
FIG. 2 is an enlarged view of a construction of the printer.

Contrarily, when the mode determination circuit 122 recognizes the single color mode based on the image data transmitted from the personal computer PC, the engine control CPU 123 activates the belt uplift mechanism 111U so that the belt position change mechanism 110 swingingly moves the tension roller 71 and spanning rollers 75, 76 and 80 etc. to a separated position indicated by a dotted line in FIG. 2, where the intermediate transfer belt 100 contacts only the photoconductive element 10B and is separated from other photoconductive elements 10Y, 10M and 10C. As a result, an operation for an image forming and printing of the black color mode with the photoconductive element 10B, surrounding developing unit 40B with liquid developer, the intermediate transfer belt 100 and so forth becomes possible. Consequently, although the intermediate transfer belt 100 rotates as in a case of the multicolor mode, the intermediate transfer belt 100 does not contact photoconductive elements 10Y, 10M and 10C which are not involved in the image formation and printing process, and thereby the life of photoconductive elements 10Y, 10M and 10C may not be decreased. Especially, because the black color mode, which is most frequently used, is set as the single color mode, the life of photoconductive elements 10Y, 10M and 10C may be advantageously extended. Because the developing units with liquid developer 40Y, 40M, 40C and 40B have the same structure as to each other and are replaceable with each other, a desired color can be easily set for the single color mode by placing a developing unit with liquid developer of the desired color at the photoconductive element located at a foremost right end (at the side of a common image transfer area).

When the cleaning device 79 is positioned at a place shown in FIG. 2, i.e., at a tip end side of the pivot of the intermediate transfer belt 100, the cleaning device 509 has to move along with the intermediate transfer belt 100 as indicated by a two-dotted and dashed line in FIG. 2. Therefore, a load imposed on the belt position change mechanism 110 is increased and a distance the cleaning device 509 has to move is also increased, which may result in inconvenience of, for example, a leakage of developer etc. According to the embodiment of the present invention, because the cleaning device 79 is located at the base end side of the pivot of the intermediate transfer 100, the increase of the load imposed on the belt position change mechanism 110 as well as the distance the cleaning device 79 moves are minimized, which may suppress inconvenience of the leakage of developer from the cleaning tank etc.

Figure 4:
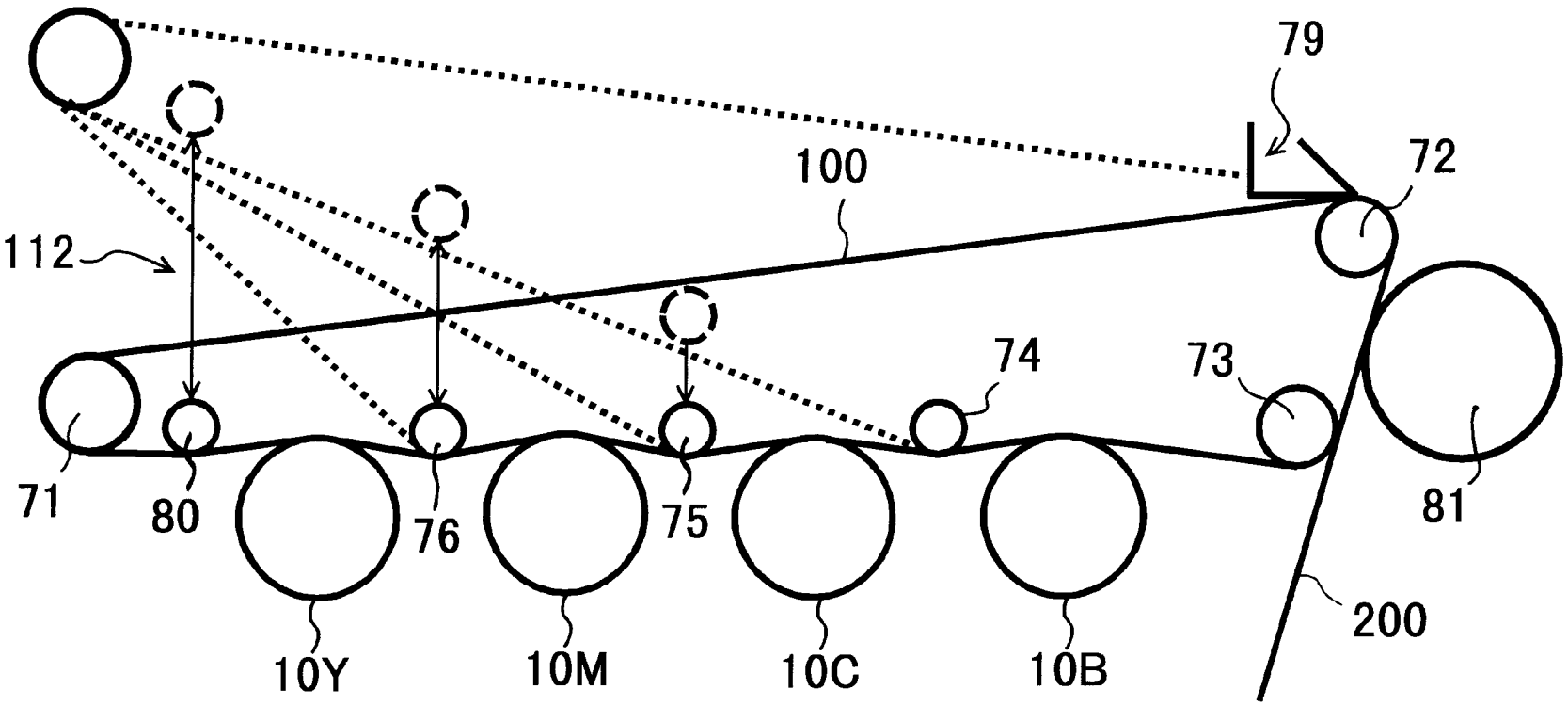
FIG. 4 is an enlarged view of a construction of a printer with another construction.

In the printer according to the embodiment of the present invention, either the black color mode (single color mode) or the multicolor mode is selectable. However in actuality, various modes with a combination of colors, such as 2 colors printing with black BK and cyan C colors, 3 colors printing with black BK, cyan C and magenta M colors and so forth, may be required. In order to cope with the requirement for various modes, a stepped belt position change mechanism 112 to change the position of spanning rollers 75, 76 and 80 in steps as shown in FIG. 4 may be employed to control a position of the intermediate transfer belt 100. The stepped belt position change mechanism 112 functions to change the number of the photoconductive elements separating from the intermediate transfer belt 100 in steps and uplifts or lifts down spanning rollers 75, 76 and 80 individually and independently. In the multicolor mode, for example, when a two colors mode with black color BK and cyan color C is set, the intermediate transfer belt 100 is brought into contact only with photoconductive elements 10C and 10B separating from photoconductive elements 10Y and 10M by uplifting the tension roller 71 and spanning rollers 76 and 80 while keeping the spanning roller 75 at a lifted down position as indicated by a chained line in FIG. 4. Further, in the multicolor mode, for example, when three colors mode with black BK, cyan C and magenta M colors is set, the intermediate transfer belt 100 is brought into contact only with photoconductive elements 10M, 10C and 10B separating from the photoconductive element 10Y by uplifting the tension roller 71 and spanning roller 80 while keeping the spanning rollers 75 and 76 at the lifted down position as indicated by a two-dotted and dashed line in FIG. 4. As a result, the position of the intermediate transfer belt 100 can be controlled precisely so as not to contact photoconductive elements which are not involved in the image forming and printing operation which advantageously extends the life of photoconductive elements 10Y, 10M and 10C.

Furthermore, the printer according to the embodiment of the present invention may be preferably configured such that mechanical devices (driving devices for the photoconductive elements and developing units) for the photoconductive elements which are separated from the intermediate transfer belt 100 (for example, photoconductive elements 10Y, 10M and 10C in a case of the black color mode) are controlled to be stopped. By this control, the life of the photoconductive elements, developing units with liquid developer and its driving devices can be extended, and a consumption of electricity and a vibration can be reduced. Further, unnecessary consumption of developer through the unnecessary operation of the developing unit is avoided.

Further, in the printer according to the embodiment of the present invention, the intermediate transfer belt 100 is configured to partly pivot so as to separate from part of the photoconductive elements, however, it may be configured such that photoconductive elements are driven to uplift or lift down so as to separate from the intermediate transfer belt 100. In this case, because the photoconductive elements, which are movable independently, change positions, the separation mechanism can be made simpler compared with the one in which the intermediate transfer belt 100 partly pivots by moving the above-described supporting rollers. Further, because the space for moving part of photoconductive elements is less than the one in which the intermediate transfer belt 100 partly pivots, it is also advantageous to reduce a size of the apparatus.

In the embodiment of the present invention, when a change in a tension of the intermediate transfer belt 100 occurs in the separation of the intermediate transfer belt 100 from part of the photoconductive elements, it is desirable to change a distance of at least one of the supporting rollers relative to the other supporting rollers. For example, the tension roller 71 may be configured to move toward the outside of the apparatus so as to suppress a change in the tension of the intermediate transfer belt 100 as explained in the following embodiment of the present invention. The intermediate transfer belt 100 can be driven accurately by the driving roller 72 by suppressing the change in the tension of the intermediate transfer belt 100.

Now, an electrophotographic copying machine with liquid toner as an example of an image forming apparatus according to the another embodiment of the present invention is explained.

Figure 5:
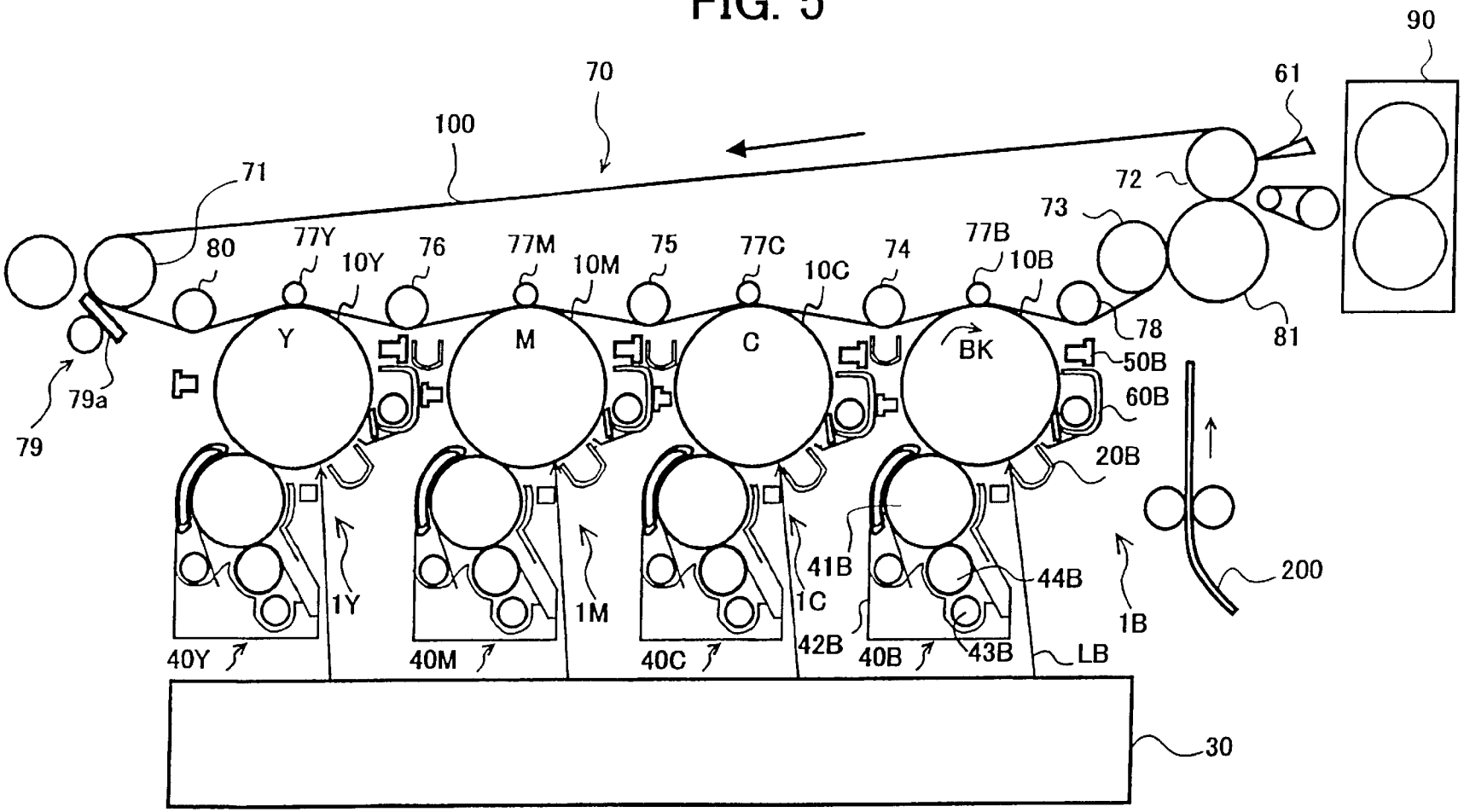
FIG. 5 is a schematic drawing illustrating an exemplary construction of a copying machine as an example of an image forming apparatus according to another embodiment of the present invention.

FIG. 5 is a schematic drawing illustrating an internal construction of the copying machine. The copying machine has four sets of image forming sections 1Y, 1M, 1C and 1B, an intermediate transfer unit 70 which is detachable/attachable to a main body of the copying machine, a fixing device 90, and an image reading unit (scanning unit), a sheet feeding unit and a controlling unit which are not shown.

The above four sets of image forming sections 1Y, 1M, 1C and 1B each includes photoconductive drums 10Y, 10M, 10C and 10B, developing units 40Y, 40M, 40C and 40B etc. Developing units 40Y, 40M, 40C and 40B use yellow toner, magenta toner, cyan toner and black toner respectively.

Electrostatic latent images of corresponding colors are formed on surfaces of corresponding photoconductive drums 10Y, 10M, 10C and 10B and are developed in respective developing units 40Y, 40M, 40C and 40B into toner images (visible images) with respective colors. The color toner images on the photoconductive drums are transferred to an intermediate transfer belt 100 being superimposed one after another, creating a multicolor toner image. Then, the multicolor toner image on the intermediate transfer belt 100 is transferred at one time to a transfer sheet 200.

Because the four sets of image forming sections have the same construction, the image forming section 1B will be described as an example of an image forming section.

The image forming section 1B includes a photoconductive drum 10B as an image bearing member, a charging device 20B to uniformly charge a surface of the photoconductive drum 10B, a laser writing unit 30 irradiating a laser beam light (LB), a liquid-type developing unit 40B, a discharging device 50B and a cleaning device 60B having a cleaning blade. A visible image is formed on the photoconductive drum 10B with the charging device 20B, the laser writing unit 30 and the developing unit 40B etc.

The liquid-type developing unit 40B includes a developing roller 41B as a developer carrier, a developer reservoir 42B to store a developer, a developer scoop up roller 43B provided so as to be immersed in liquid developer in the developer reservoir 42B and a developer coating roller 44B which laminates and coats the developer scooped up by the developer scoop up roller 43B on the developing roller 41B.

The liquid developer used in the liquid-type developing unit includes toner particles to make a latent image visible, which are dispersed at a high ratio in a carrier liquid and insulating material, having a viscosity as high as 100 to 10,000 mPa s.

The intermediate transfer unit 70 includes supporting rollers 71, 72, 73, 74, 75, 76, 78 and 80, the intermediate transfer belt 100 (opposing member) which is spanned around those rollers, primary transfer bias rollers 77B, 77Y, 77M and 77C as primary transfer bias applying members and an intermediate transfer belt cleaning device 79 having a cleaning blade 79*a*. The supporting roller 72 is connected to a driving means (not shown) and is configured to function as a drive roller also to rotatively drive the intermediate transfer belt 100.

It is preferable that the intermediate transfer belt 100 is elastic at its surface contacting a transfer sheet without being elastic in a circumferential direction. Because the elastic surface of the intermediate transfer belt 100 is brought into intimate contact with the transfer sheet by adhering to a concave surface of the transfer sheet, a satisfactory transfer of the toner image onto the transfer sheet can be obtained.

As in the first embodiment the intermediate transfer belt 100, may be configured to be a double layer construction, having a first layer including an elastic member formed on a surface side where a toner image formed and a second layer including a resin sheet is formed on a back side thereof, and having a volume resistivity of $10^7$ to $10^{12}$ Ωcm. For the first layer, a polyurethan rubber layer of 200 to 700 μm in thickness may be used. And as for the resin sheet layer, a polyurethan resin sheet of 100 to 500 μm in thickness, which is not stretched in a circumferential direction, may be used. Further, the intermediate transfer belt 100 may include a combination of a first layer of rubber formed on the surface (e.g. a nitrile rubber, a urethan rubber, the Butyl-rubber and a natural rubber) and a second layer of a fiber buried rubber, or a combination of a first coated layer including a fluorine resin and a second layer of an elastic conductive element having the volume resistivity of $10^5$ to $10^9$ Ωcm. The elastic conductive element may include a polyurethan rubber with carbon dispersed.

When the intermediate transfer belt 100 is configured to have the thickness of 200 to 2000 μm, a volume resistivity of $10^5$ to $10^9$ Ωcm and a hardness of 15° to 80° in JIS A (Japanese Industrial Standards A), a specified effect will be obtained. The non-elastic core prevents the elastic conductive element from being stretched in the circumferential direction and it may include, for example, a nylon cord or a steel cord of 50 to 400 μm in diameter. The surface coated layer is provided to increase a transferability of a secondary transfer by improving a release of toner particles and to achieve a smoother separation of the transfer sheet 200 after the secondary transfer operation. The surface coated layer may include, for example, a layer including a fluorine resin coated in 5 to 60 μm thickness.

As for supporting rollers 71–76 and 80, a grounded conductive roller (e.g. a metal roller) may be used. As for the primary transfer roller 77 and the secondary transfer roller 81, a columned or cylindrical-shaped conductive roller (e.g. a metal roller or a metal pipe) having a conductive rubber layer (e.g. a hydrin rubber) on its surface may be used.

When the intermediate transfer belt 100 having a conductive layer on its underside is used, a floating state conductive roller (e.g. a metal roller) or a nonconductive roller is used for supporting rollers 72–76 and 80 other than the tension roller 71 and for the primary transfer roller 77. The tension roller 71 is made of a conductive roller so that the conductive layer of the intermediate transfer belt 100 has a predetermined potential by a bias voltage applied to the tension roller 71. When the transfer bias is applied to the secondary transfer roller 81, a transfer electric field is formed by the potential difference between the conductive layer of the intermediate transfer belt 100 and the secondary transfer roller 81.

A secondary transfer section to transfer a toner image formed on the intermediate transfer belt 100 to the transfer sheet 200 includes a secondary transfer roller 81 around which the intermediate transfer belt 100 windingly contacts and forms a secondary transfer nip therebetween and a secondary transfer power supply (not shown) as a transfer bias applying device, connected to the secondary transfer roller 81.

The intermediate transfer belt 100 is windingly brought into contact with the photoconductive drums 10B, 10C, 10M and 10Y with specified contacting angles by the supporting rollers 74, 75, 76, 78 and 80 (hereinafter referred to as spanning roller as necessary) which are located adjacent to respective photoconductive drums. The intermediate transfer belt 100 is spanned around a supporting roller 71 located at the left end in FIG. 5 with the greatest contacting angle (hereinafter referred to as a tension roller as necessary) so as to maintain a specified belt tension. Further, the intermediate transfer belt 100 is rotatively driven in a counterclockwise direction indicated by an arrow by a supporting roller 72 (hereinafter referred to as a driving roller as necessary) opposite to a secondary transfer roller 81 located at the right end in FIG. 5. The primary transfer bias roller 77B is provided opposite to the photoconductive drum 10B and the intermediate transfer belt 100 is interposed between the primary transfer roller 77B and the photoconductive drum 10B. The primary transfer roller 77B also functions as an electrode applying a primary transfer bias while being applied with a specified primary transfer bias by a primary transfer power supply (not shown).

Figure 6:
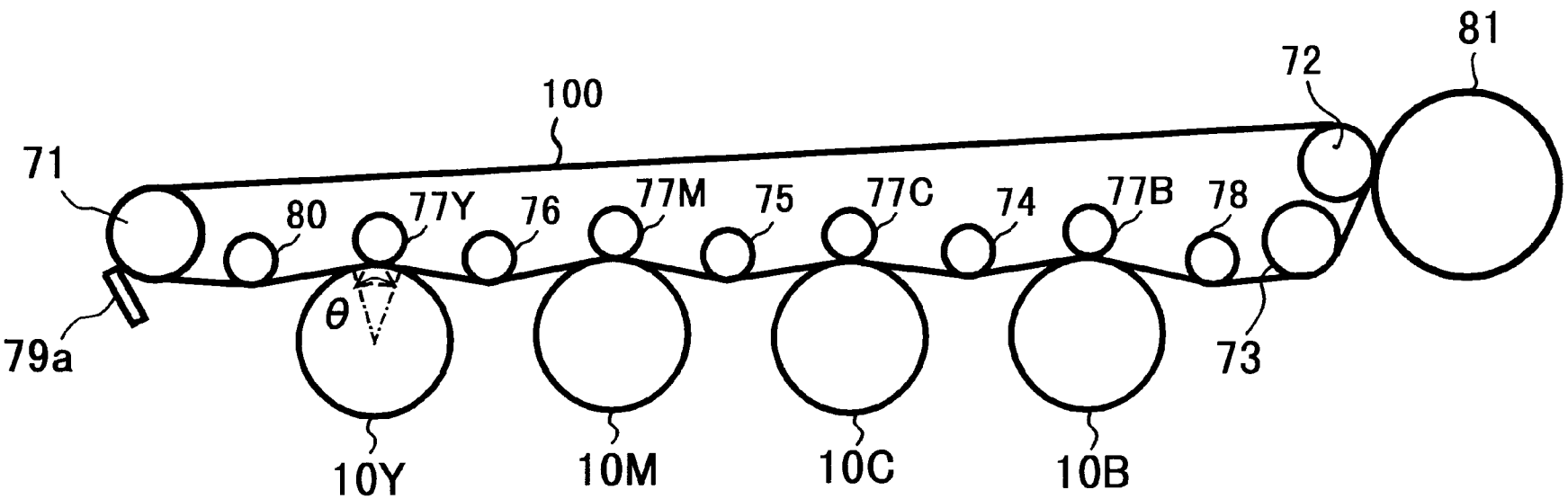
FIG. 6 explains a location of an intermediate transfer belt in a multicolor mode of the copying machine.
Figure 7:
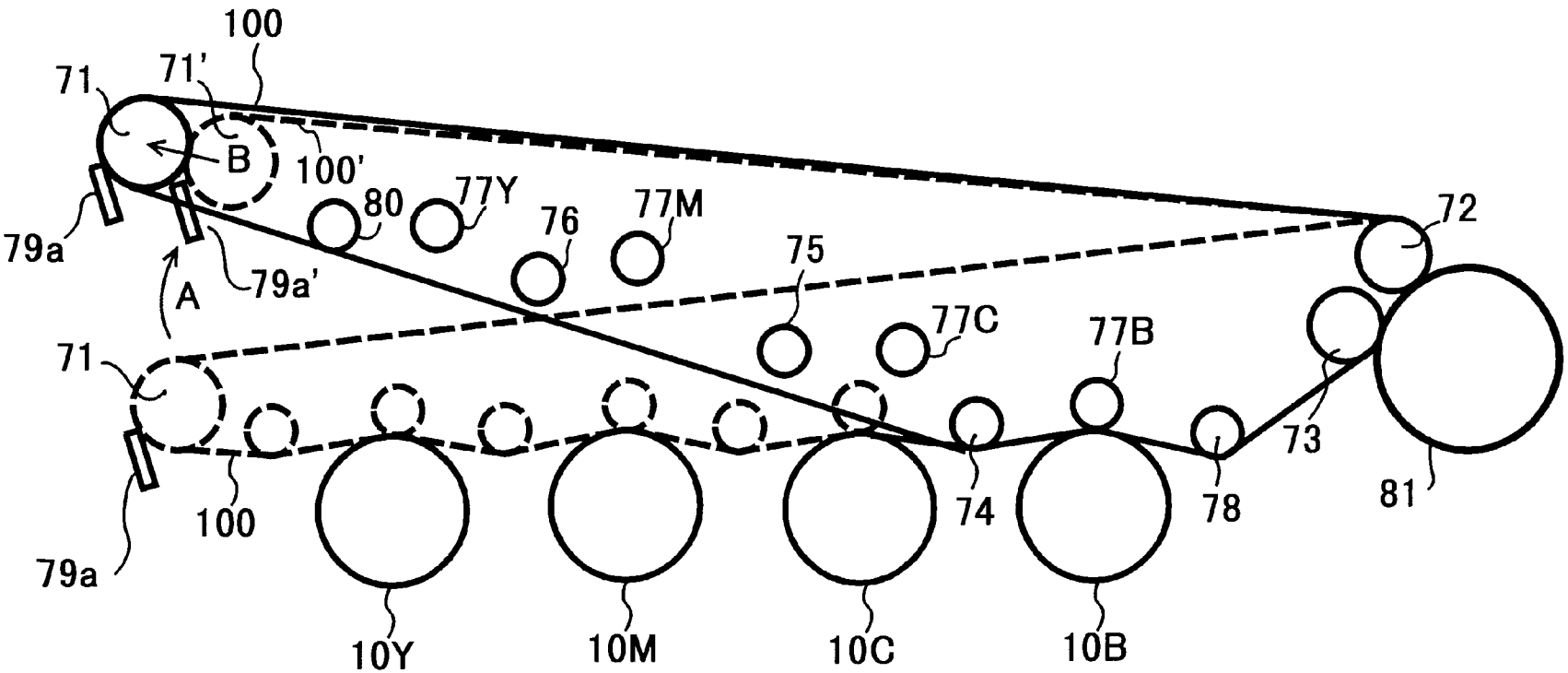
FIG. 7 explains a location of the intermediate transfer belt in a black color mode of the copying machine.

FIGS. 6 and 7 illustrate locations of the intermediate transfer belt 100 in multicolor and black and white image forming processes respectively. In the multicolor image forming process shown in FIG. 6, the intermediate transfer belt 100 is supported by respective supporting rollers so as to contact the photoconductive drums 10B, 10Y, 10M and 10C with a specified contacting angle of θ.

In the black and white image forming process illustrated in FIG. 7, the intermediate transfer belt 100 moves to a position where the intermediate transfer belt 100 is separated from the photoconductive drums 10Y, 10M and 10C while it remains in contact with only the photoconductive drum 10B for black color, the drum closest to a secondary transfer area, located at the right end in FIG. 7. A separation device, for moving the intermediate transfer belt 100 to the separated position, pivotably moves a pivot subunit (not shown), to which shafts of the supporting rollers 71, 75, 76 and 80 and the primary transfer roller 77Y, 77M and 77C are attached, about the spanning roller 74 located between the photoconductive drums 10B and 10C, by a pivot mechanism (not shown), in a clockwise direction as indicated by arrow A in FIG. 7.

Figure 8:
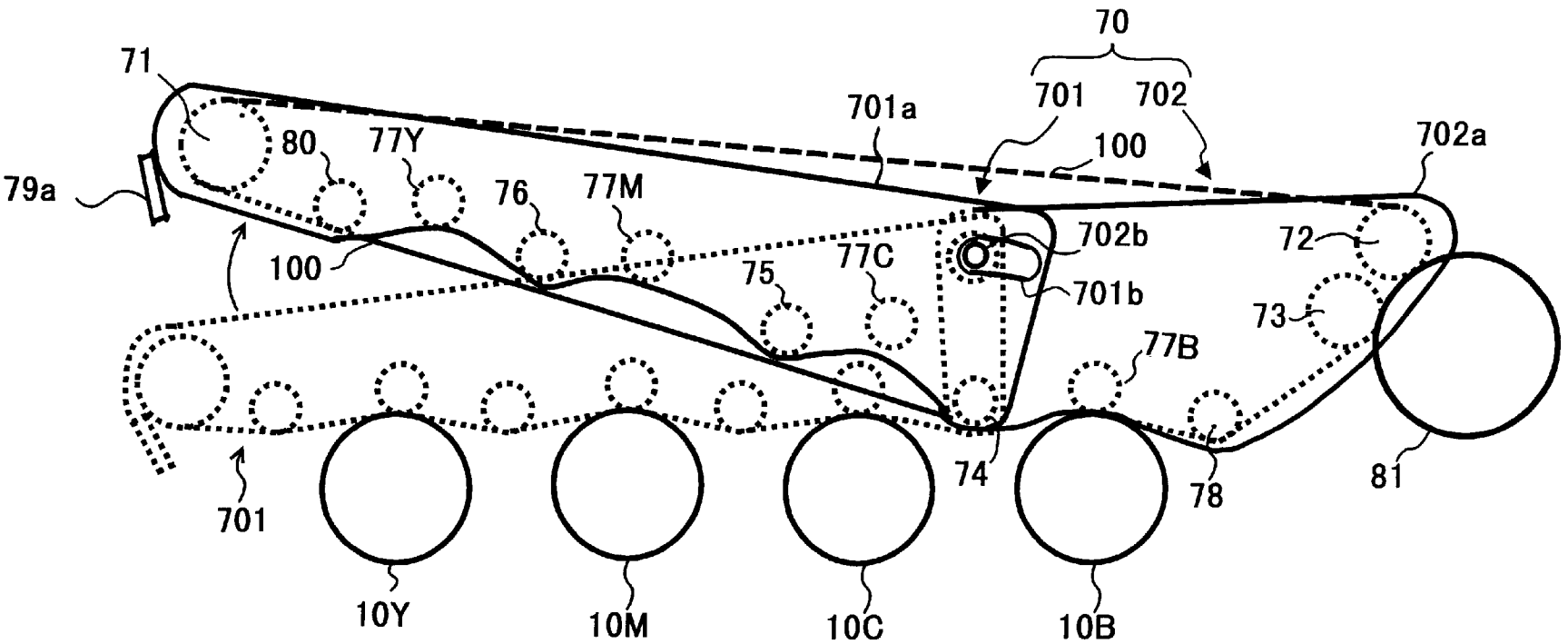
FIG. 8 explains a mechanism of a pivot subunit.

FIG. 8 explains a pivot mechanism of the pivot subunit 701 which is part of the intermediate transfer unit 70. The intermediate transfer unit 70 includes the pivotable pivot subunit 701 and a fixed subunit 702. Spanning rollers 75, 76 and 80, and primary transfer rollers 77Y, 77M and 77C are rotatably provided to a sideboard 701*a* of the pivot subunit 701. The primary transfer roller 77B for black color, the driving roller 72, the guide roller 73 and spanning rollers 74 and 78 are rotatably provided to a sideboard 702*a* of the fixed subunit 702. The pivot subunit 701 pivots about the shaft of the fixed spanning roller 74. Above the spanning roller 74, an oblong hole 701*b* for the pivot is provided on the sideboard 701*a* so that a guide pin 702*b* provided to the fixed subunit 702 passes through the oblong hole 701*b*. When the pivot subunit 701 pivots, the guide pin 702*b* guides the pivoting of the pivot subunit 701.

Figure 9:
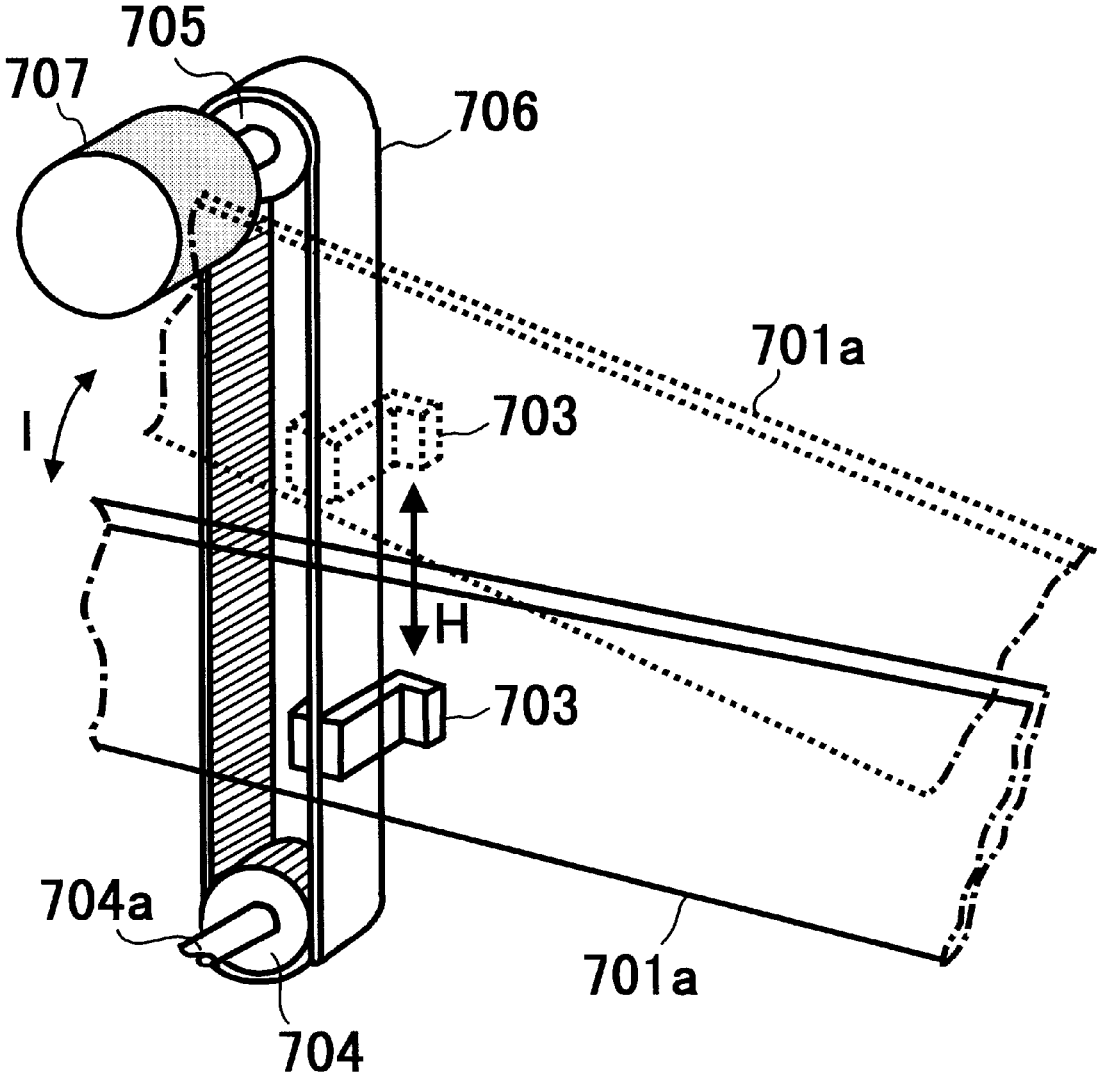
FIG. 9 explains a driving, section of the pivot mechanism.

FIG. 9 illustrates a driving section of the pivot mechanism to pivot the pivot subunit 701. The driving section includes a timing belt 706 in an endless form spanned around pulleys 704 and 705. A shaft 704*a* of the pulley 704 is rotatably supported by a main body of the apparatus. The pulley 705 is connected to a rotation shaft of a motor 707 that is supported by the main body of the apparatus. The motor 707 can reverse the direction of rotation and is controlled by an engine control CPU (central processing unit) described later. A fixing member 703 is provided at a spanned portion of the timing belt 706 between pulleys 704 and 705 so as to sandwich support the timing belt 706. The fixing member 703 is fixed to the sideboard 701*a* of the pivot subunit 701.

In the above-described driving section, when the motor 701 rotates in a normal or reverse direction, the fixing member 703 moves in a vertical direction (in a direction indicated by a double-headed arrow H in FIG. 9) along with the movement of the timing belt 706. By the movement of the fixing member 703, the pivot subunit 701, to which the fixing member 703 is fixed, pivots as indicated by an arrow I in FIG. 9.

When the intermediate transfer belt 100 is moved to the separated position, the intermediate transfer belt 100 is slackened and a tension of the intermediate transfer belt 100 tends to be reduced. Therefore, a relative distance change device is provided to move the tension roller 71 in a direction (the direction indicated by an arrow B in FIG. 7) that increases a relative distance of the tension roller 71 and the other supporting rollers when the above mentioned supporting rollers etc. are rotatively moved. The movement of the tension roller 71 prevents the tension of the intermediate transfer belt 100 from lowering. Positions of parts designated with a dash (') in FIG. 7 (and in FIG. 10) show virtual intermediate positions of the corresponding parts when they are moved.

Figure 10:
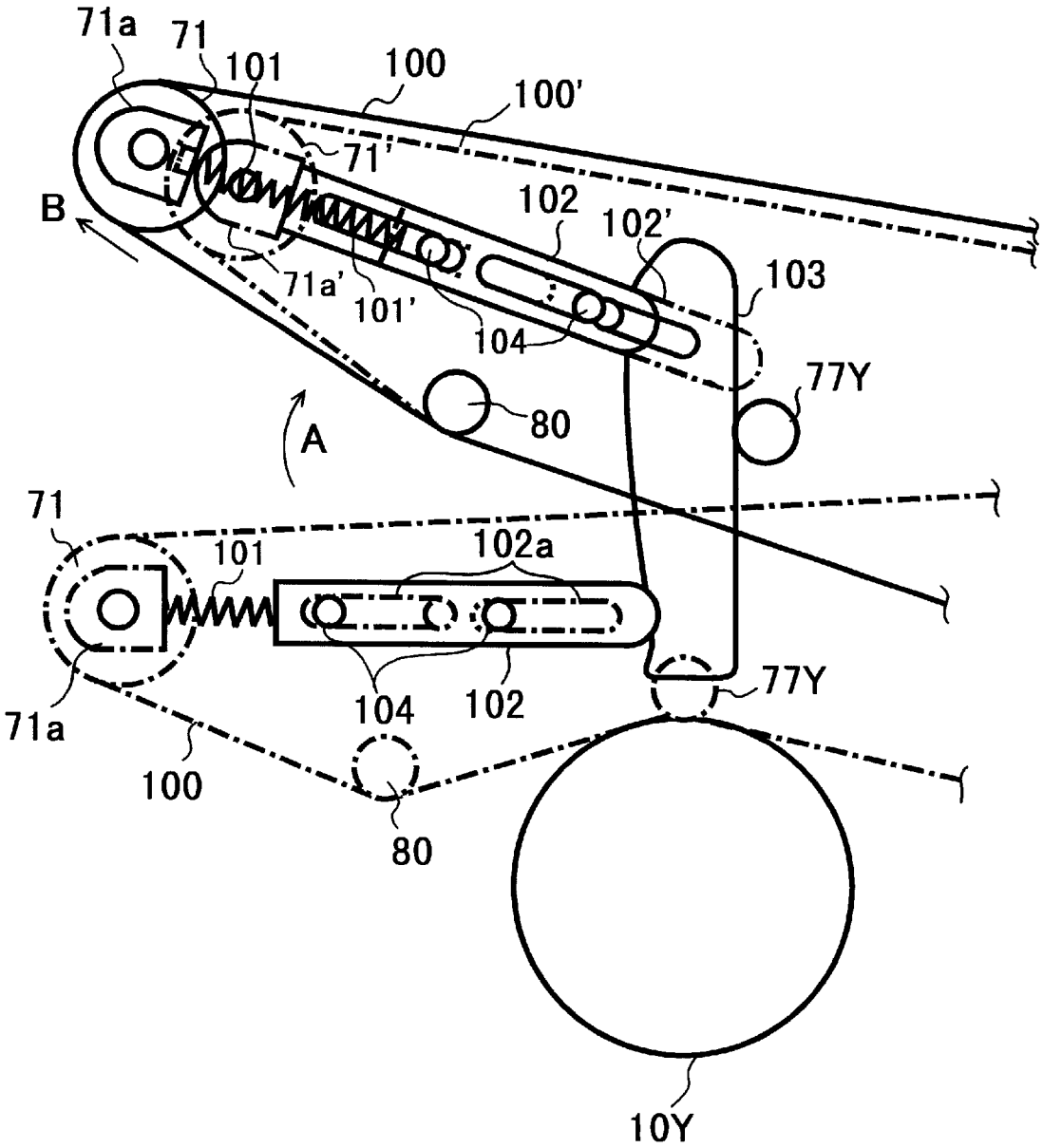
FIG. 10 is an enlarged sectional view illustrating a construction of a tension roller driving mechanism.
Figure 11:
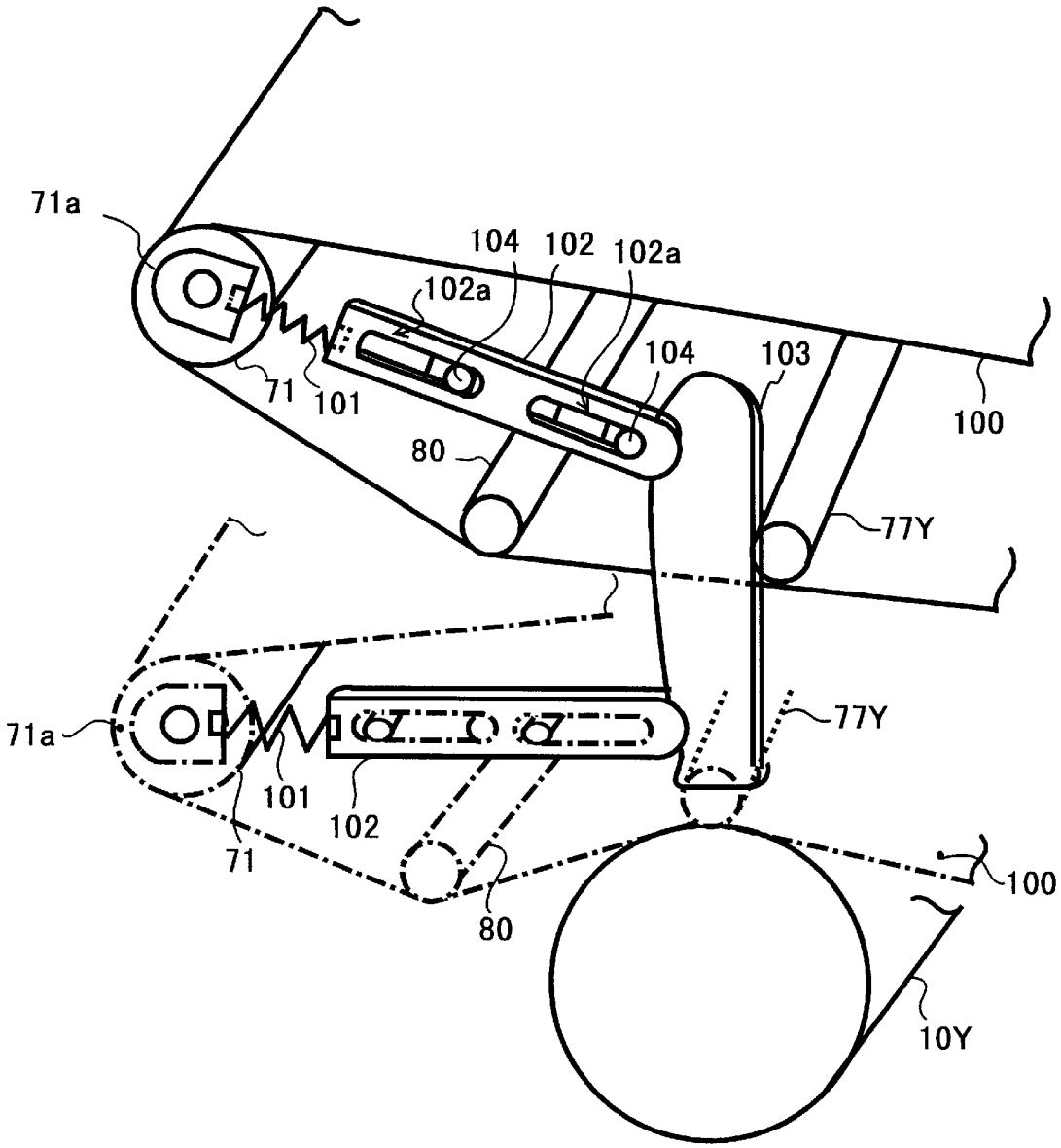
FIG. 11 is an enlarged partial perspective view illustrating a construction of the tension roller driving, mechanism.

FIGS. 10 and 11 are expanded sectional and perspective views respectively illustrating an example of a tension roller driving mechanism as the relative distance changing device according an embodiment of the present invention. The tension roller driving mechanism includes a biasing member that moves together with the tension roller 71 and applies a resilient bias to a bearing 71*a* for the tension roller 71 so that the tension roller 71 press contacts the intermediate transfer belt 100. The tension roller driving mechanism also includes a fixed guide member 103 which thrusts an other end of a junction member 102 to move the biasing member toward the tension roller 71. The biasing member includes a spring 101, an end of which touches the bearing 71*a* of the tension roller 71 and the junction member 102 performs a reciprocating motion being thrusted by an other end of the spring 101. The junction member 102 includes two oblong holes 102*a* and pins 104 attached to the side of the pivot unit through the oblong holes 102*a*. The junction member 102 performs reciprocating motion while being supported by the pins 104 and pivots together with the tension roller 71.

Figure 12:
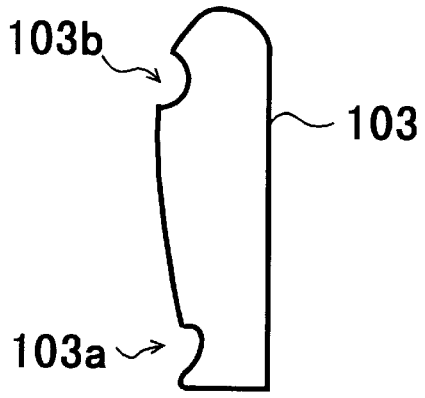
FIG. 12 is a front view illustrating a fixed guide member employed in the tension roller driving mechanism.

The fixed guide member 103 is fixed to a body of the image forming apparatus and includes recesses 103*a* and 103*b* where an end of the junction member 102 is engagedly held temporarily in the multicolor and the black and white image forming processes respectively as illustrated in FIG. 12. Because the end of the junction member 102 is engagedly held with the recesses 103*a* or 103*b* of the fixed guide member 103, the end of the junction member can be held firmly in respective positions that stabilizes the tension of the intermediate transfer belt 100 maintained by the junction member 102 via the spring 101.

For the fixed guide member 103, a resin that possesses a low coefficient of friction such as polyacetal, polycarbonate and polyamide is preferable. Because a friction produced when the end of the junction member 102 moves in contact with a surface of the fixed guide member 103 is lowered, a load imposed on the pivot of the pivot subunit 701, which includes part of the above mentioned supporting rollers, is decreased.

Figure 13:
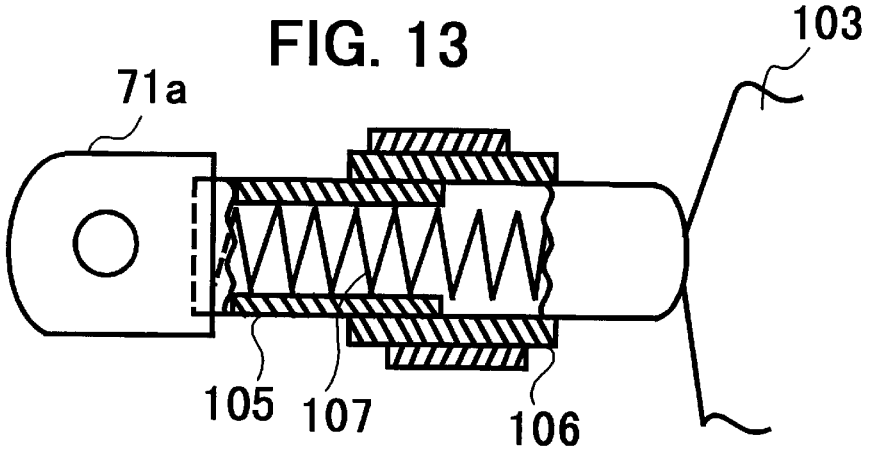
FIG. 13 is a partial sectional view illustrating another exemplary construction of the tension roller driving mechanism.

For the biasing member to apply a resilient bias to the bearing 71*a* of the tension roller 71, a set of cylindroid members 105 and 106 with different diameters, which are configured such that one cylindroid member moves back and forth through the other cylindroid member having a spring 107 in it as illustrated in FIG. 13. An end of the cylindroid member 105 is attached to the bearing 71*a* of the tension roller 71. The other cylindroid member 106 is fixed to the pivot subunit 701 so as to perform a reciprocating movement and to contact the fixed guide member 103 at its end.

Figure 14:
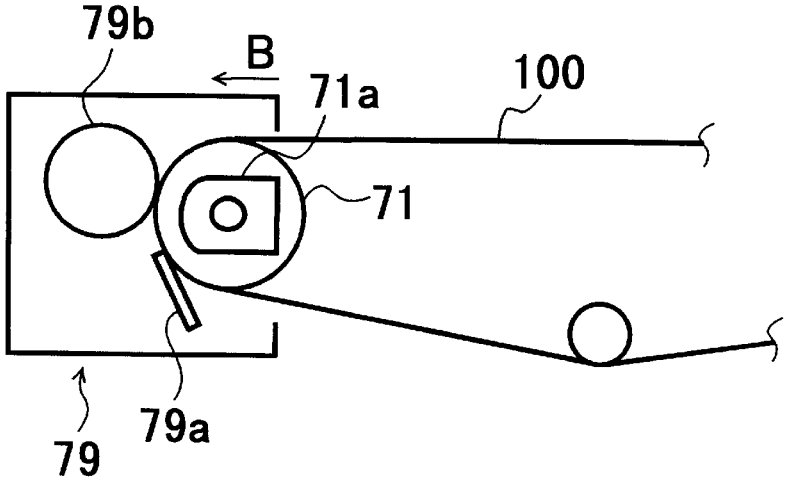
FIG. 14 is an enlarged view illustrating a cleaning device provided to the tension roller.

As illustrated in FIG. 14, the cleaning unit 79 including a cleaning blade 79*a* and a cleaning roller 79*b* is configured to move integrally with a bearing 71*a* of the tension roller 71. Accordingly, even when the tension roller 71 is moved in a direction indicated by an arrow B in FIG. 14, the cleaning blade 79*a* and the cleaning roller 79*b* of the cleaning device 79 securely contact the intermediate transfer belt 100, and thereby a satisfactory cleaning performance for the intermediate transfer belt 100 is maintained.

Figure 15:
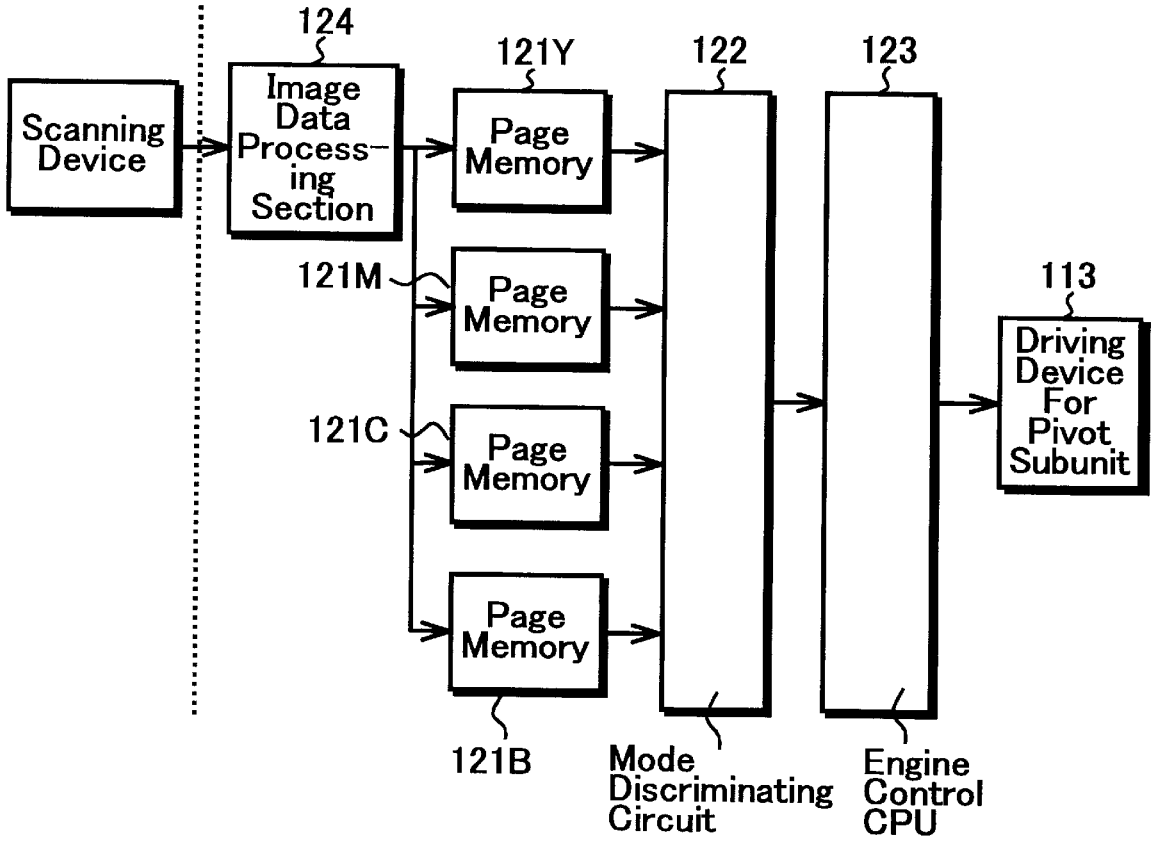
FIG. 15 is a block diagram illustrating a date processing system of the copying machine according to another embodiment of the present invention.

FIG. 15 is a block diagram explaining a data process control system of the copying machine according to embodiment of the present invention. Image data transmitted from a scanning device is converted to image data corresponding to respective colors at an image data processing section 124 and is stored in page memories 121Y, 121M, 121C and 121B corresponding to respective colors of yellow, magenta, cyan and black. The mode determination circuit 122 determines a single color mode (black color mode) or a multicolor mode based on the image data output from each page memory. The engine control CPU 123 controls a driving device 113 for the pivot subunit 701 etc. according to a result of an image forming mode discrimination at the mode discrimination circuit 122. By this control, unnecessary contact of the intermediate transfer belt 100 with the photoconductive elements 10Y, 10M and 10C which are not used and the change in the tension of the intermediate transfer belt 100 can be avoided according to the determined image forming mode. Especially, when the image forming operation is switched from the black color mode to the multicolor mode, it is preferable that the apparatus is controlled such that the pivot subunit 701 pivots and rotatively drives the intermediate transfer belt 100 and cleans the intermediate transfer belt 100 two or more times by the cleaning device 79 utilizing a time when image data for the multicolor image forming is processed. By this control, a time for the copying machine to start the image forming operation after a copy start button is pressed is shortened and the cleaning performance for the intermediate transfer belt 100 is enhanced without taking an additional time for the cleaning.

Next, an image forming operation of the copying machine will be described. As illustrated in FIG. 5, a surface of the photoconductive drum 10B is uniformly charged with a charging device 20B while the photoconductive drum 10B is rotating in a direction indicated by an arrow. Then, an electrostatic latent image is formed on the surface of the photoconductive drum 10B being exposed to a laser light beam LB irradiated from the laser writing unit 30. The developing roller 41B is uniformly coated, for example, in the thickness of about 0.5 to 20 $\mu$m, via the developer applying roller 44B with liquid developer adhered to the developer scoop up roller 43B which is immersed in high-viscosity liquid developer in the developer reservoir 42B. The developing roller 41B is brought into contact with the photoconductive drum 10B so that toner in liquid developer is applied to the latent image formed on the surface of the photoconductive drum 10B by virtue of an electric field, and thereby a visible toner image is formed.

The toner image formed on the photoconductive drum 10B is moved to a primary transfer area along with the rotation of the photoconductive drum 10B where the photoconductive drum 10B abuts against the intermediate transfer belt 100. In the primary transfer area, a back of the intermediate transfer belt 100 is applied with a negative bias voltage of, for example, −300 to −500, through the primary transfer bias roller 77B. Then the toner of the toner image formed on the photoconductive drum 10B is attracted to the intermediate transfer belt 100 by a force of an electric field generated by the applied voltage to transfer the toner image to the intermediate transfer belt 100 (a primary transfer). The toner image is formed on the intermediate transfer belt 100 in order of yellow, magenta, cyan and black, and the toner images of respective colors are transferred to the intermediate transfer belt 100 superimposed one after another to form a full color image (visible image).

The intermediate transfer belt 100 having the multicolor toner image travels to a secondary transfer area where the intermediate transfer belt 100 abuts against a transfer sheet 200 conveyed from a sheet feeding unit (not shown) in a direction indicated by an arrow in FIG. 5. In the secondary transfer area, a back of the transfer sheet 200 is applied with a negative bias voltage of, e.g., −800 to −2000 through the secondary transfer roller 81, which presses the transfer sheet 200 with a force of about 50 N/cm$^2$. The toner on the intermediate transfer belt 10 is attracted and transferred onto the transfer sheet 200 at one time by virtue of an electric field generated by the application of the voltage and the pressure exerted to the transfer sheet 200 (a secondary transfer).

The transfer sheet 200 carrying the transferred toner image is separated from the intermediate transfer belt 100 by a transfer sheet separation member 61 and is discharged to an exit tray after the toner imager is fixed onto the transfer sheet 200 by a toner image fixing device 90. After the secondary transfer operation, the surface of the photoconductive drum 10B is uniformly discharged by a discharging device 50B and is cleaned by a cleaning device 60B and remaining residual toner is removed to be ready for a next image forming operation.

When a black and white image is formed in the above configured copying machine, as illustrated in FIG. 7, the pivot subunit (not shown) disposed at the side of a color image forming section pivots while an image forming operation is not performed such that the intermediate transfer belt 100 moves to the separated position where the intermediate transfer belt 100 remains in contact only with the photoconductive drum 10B for black color which is the closest drum to the secondary transfer area, (disposed at the right side end in FIG. 7) while being separated from the other photoconductive drums 10Y, 10M and 10C. A toner image is formed only on the surface of the photoconductive drum 10B and is then transferred to the intermediate transfer belt 100. The toner image on the intermediate transfer belt 100 is then transferred onto the transfer sheet 200 at the secondary transfer area to form a black and white image on the transfer sheet 200.

According to the embodiment of the present invention, even when the intermediate transfer belt 100 is tentatively separated from the three photoconductive drums 10Y, 10M and 10C for the multicolor image forming process in a black and white image forming operation, a change in the intermediate transfer belt 100 is suppressed and thereby the intermediate transfer belt 100 is frictionally driven accurately. Thus a quality degradation of a produced image caused by a deviation of the image position or image size etc. is suppressed.

According to the embodiment of the present invention, the tension roller 71, with which the intermediate transfer belt 100 is in contact with the largest contacting angle among the supporting rollers, moves when the intermediate transfer belt 100 moves to the separated position.

Figure 16A:
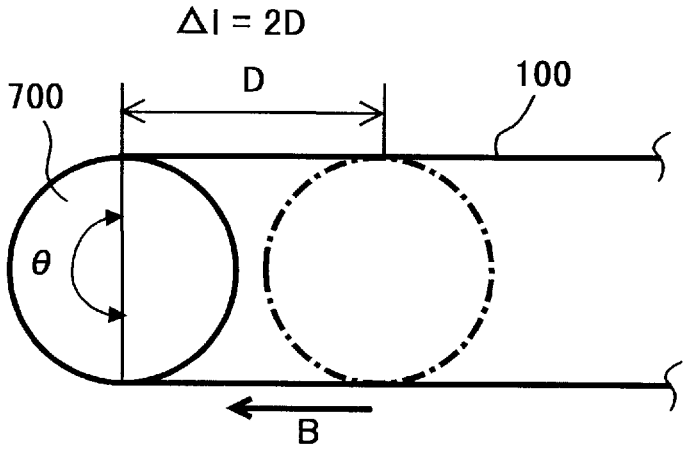
FIGS. 16A and 16B explain a relation between a contacting angle (θ) of the intermediate transfer belt and an amount of change in a circumferential length (Δ1) of the intermediate transfer belt when a supporting roller is moved.
Figure 16B:
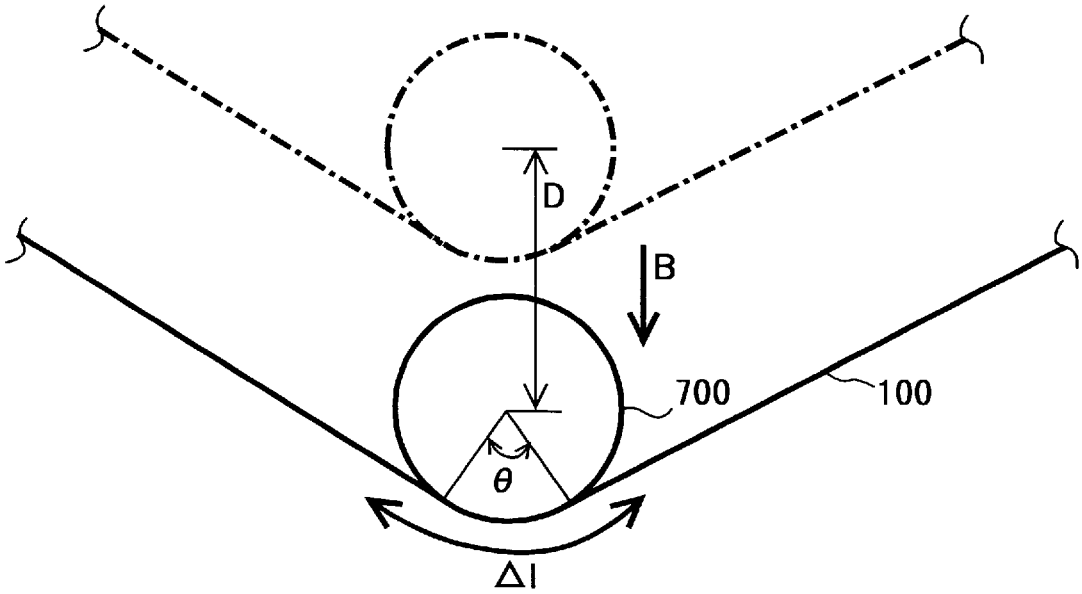

Generally, the larger the contacting angle of the intermediate transfer belt 100 with a supporting roller is, the larger the amount of a change in a circumferential length of the intermediate transfer belt 100 relative to a unit of travel of the supporting roller is. For example, when a contacting angle ($\theta$) of the intermediate transfer belt 100 with a supporting roller 700 is 180°, the amount of a change ($\Delta$1) in the circumferential length of the intermediate transfer belt 100 is 2D when the supporting roller 700 is moved by a distance of D toward the outside of the apparatus as indicated by an arrow B in FIG. 16A. Contrarily, as shown in FIG. 16B, when the contacting angle ($\theta$) of the intermediate transfer belt 100 with the supporting roller 70 is less than 180°, the amount of a change ($\Delta$1) in a circumferential length of the intermediate transfer belt 100 is less than 2D even when the supporting roller 700 is moved toward the outside of the apparatus by the same distance of D described in FIG. 16A.

In this embodiment, because the tension roller 71, with which the intermediate transfer belt 100 is in contact and which has the largest contacting angle among the supporting rollers, is moved, the amount of movement of the tension roller 71 to prevent the tension of the intermediate transfer belt 100 from being decreased is minimized.

Figure 17:
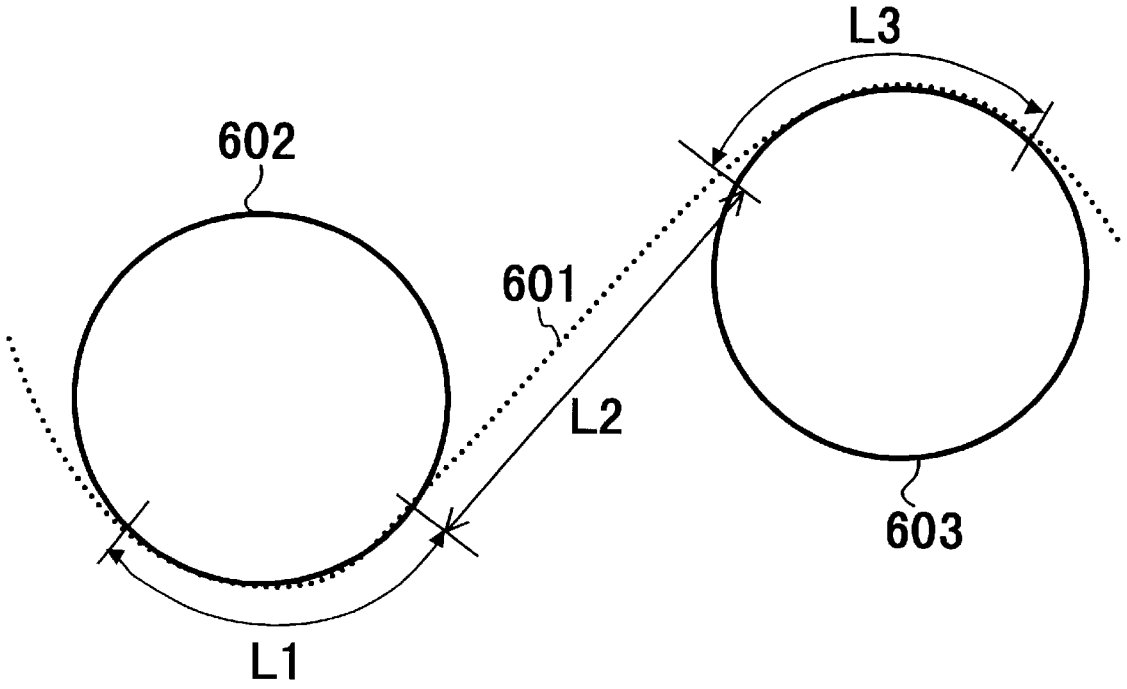
FIG. 17 explains a contacting length (L1) and a non-contacting length (L2) of the intermediate transfer belt.

Further, the amount of a movement of the tension roller 71 is set such that the intermediate transfer belt 100 is spanned around a plurality of supporting rollers while being tensioned when the intermediate transfer belt 100 is pivoted such that, referring to FIG. 17, a sum of (1) a length of a path out of an intermediate transfer belt path 601 over which the intermediate transfer belt 100 windingly in contact with a plurality of contacting members such as the supporting rollers etc. and (2) a length of a path out of the intermediate transfer belt path 601 over which the intermediate transfer belt 100 is not in contact with any contacting member, does not change. As illustrated in FIG. 17, L1 and L3 are the length of paths over which the intermediate transfer belt 100 windingly in contact with contacting members 602 and 603, respectively. L2 is the length of the path over which the intermediate transfer belt 100 is spanned straightly between contacting members 602 and 603 where the intermediate transfer belt 100 does not contact any contacting member. In this embodiment, contacting members 602 and 603 correspond to supporting rollers and photoconductive elements.

The change in the tension of the intermediate transfer belt 100 is securely suppressed by setting the amount of the movement of the tension roller 71 as described above.

Figure 18:
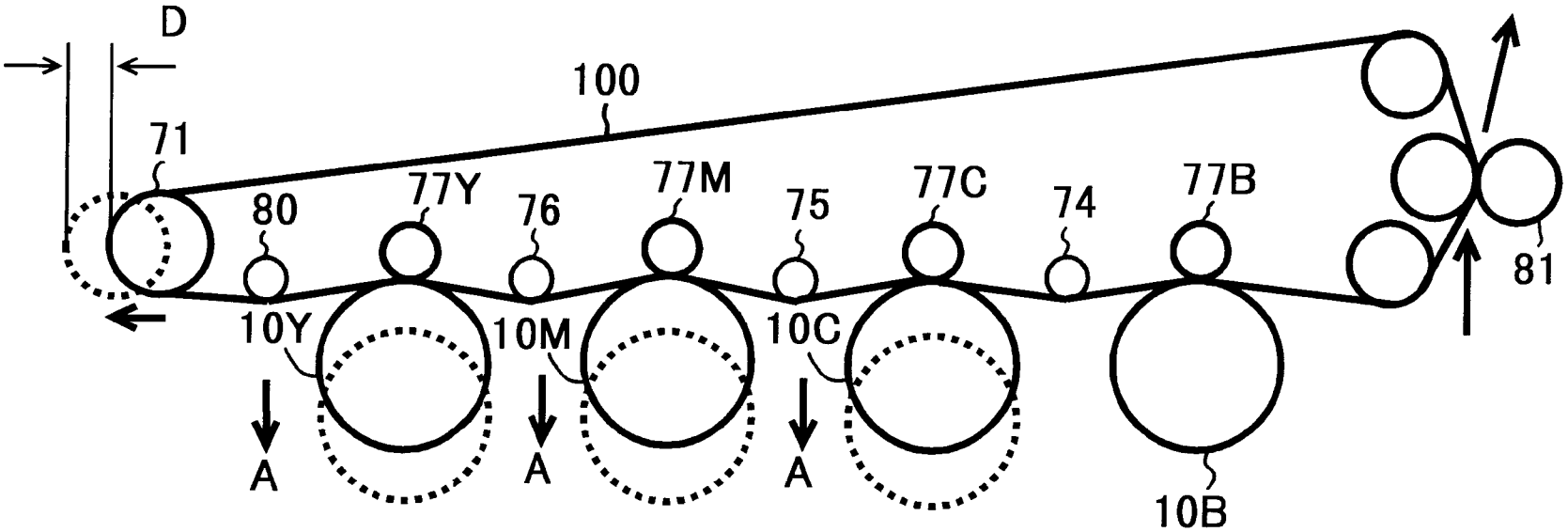
FIG. 18 is an enlarged view of a construction of the image forming apparatus according to another embodiment of the present invention.

In the above-described embodiment of the present invention, the intermediate transfer belt 100 is configured to partly pivot so as to separate from part of photoconductive elements 10Y, 10M, 10C and 10B, however, as illustrated in FIG. 18, part of photoconductive elements 10Y, 10M and 10C may be configured to be brought down so as to be separated from the intermediate transfer belt 100. The change in the tension of the intermediate transfer belt 100 can be suppressed by moving the tension roller 71, along with the separating movement, by a specified distance D in a direction of a tension applied to the intermediate transfer belt 100.

A mechanism to move the photoconductive elements can be simpler compared with the one that partly pivots the intermediate transfer belt 100 as described above. It is also advantageous in reducing the size of the apparatus because the mechanism to move the photoconductive elements requires less space than the one to move the intermediate transfer belt 100.

Figure 19A:
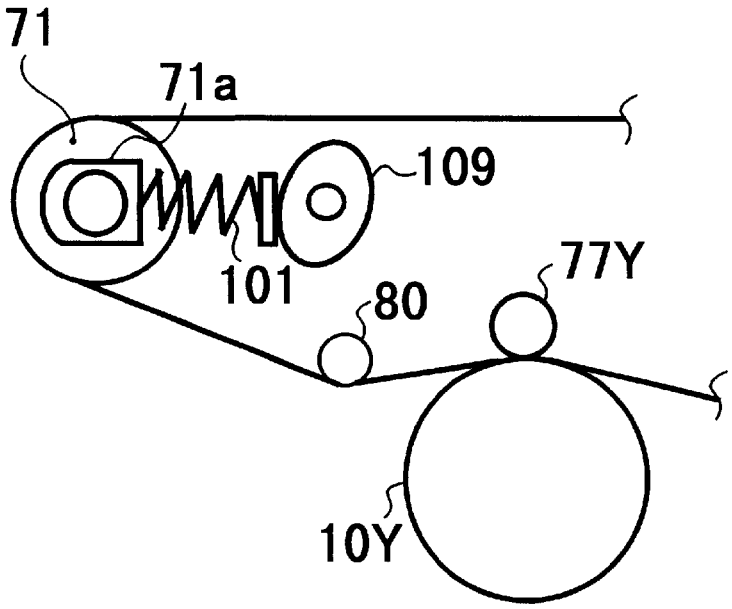
FIGS. 19A and 19B are enlarged sectional views illustrating the tension roller driving mechanism.
Figure 19B:
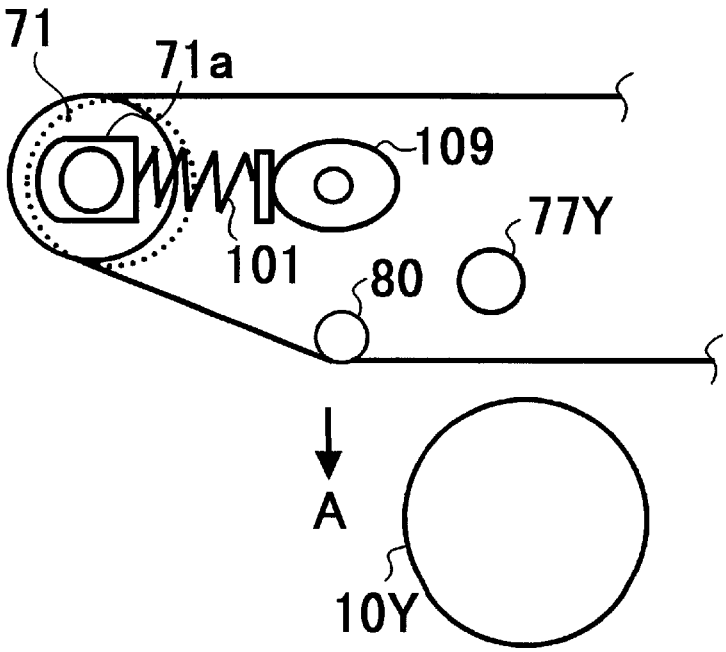

An eccentric cam 109 may be employed in a mechanism to move the tension roller 71 as illustrated in FIGS. 19A and 19B. The eccentric cam 109 is rotated about 90° i.e., from a state illustrated in FIG. 19A to a state in FIG. 19B so as to move the tension roller 71 by thrusting the bearing 71*a* through a spring 101. Especially, when the eccentric cam 109 is employed, because the tension roller 71 can be moved in multiple steps by adjusting the angle of the rotation of the eccentric cam 109, an adjustment of the tension of the intermediate transfer belt 100 can be easily made.

Figure 20:
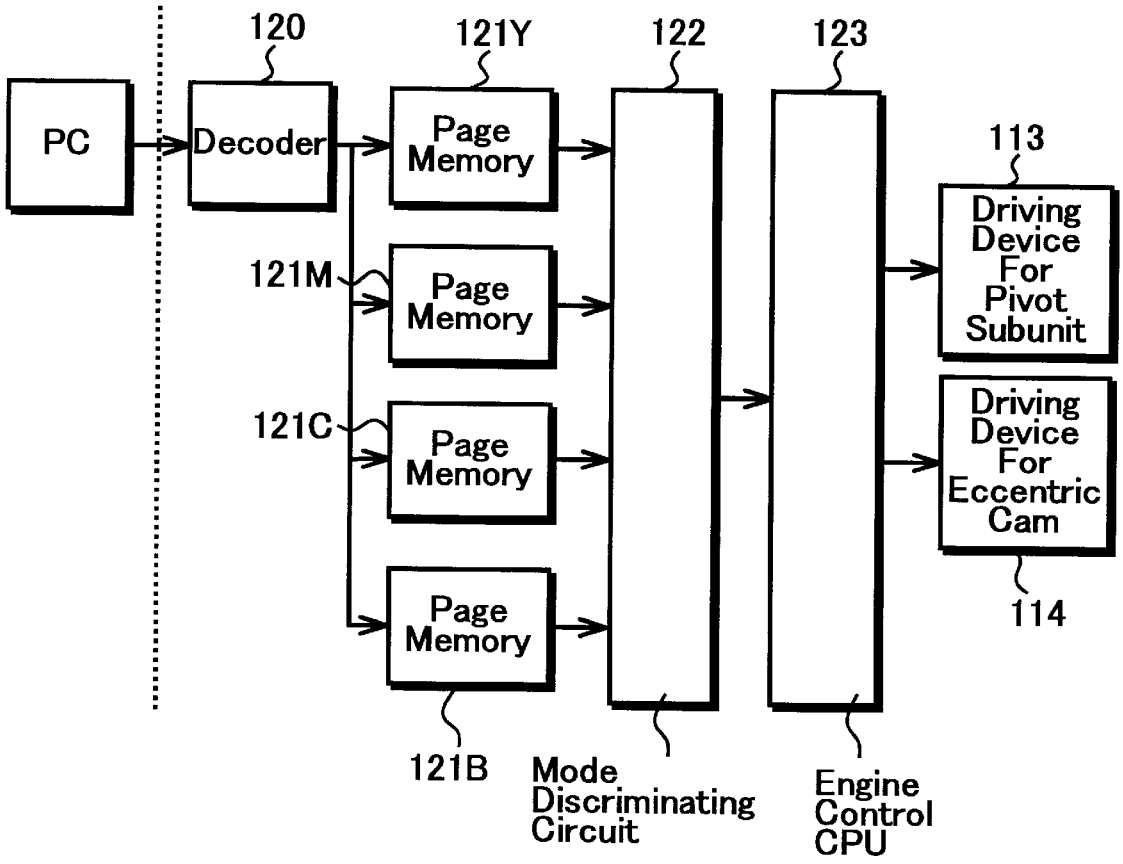
FIG. 20 is a block diagram illustrating a data processing system of the image forming apparatus.

FIG. 20 is a block diagram explaining a data process control system of the image forming apparatus (a printer) configured to move the tension roller 71 by the eccentric cam 109. In the image forming apparatus, the driving device 114 for the eccentric cam 109 and the driving device 113 for the pivot subunit 701 are controlled according to a result of an image forming mode discrimination. By this control, unnecessary contact of the intermediate transfer belt 100 with photoconductive elements and a change in the tension of the intermediate transfer belt 100 are securely avoided in response to the determination of the image forming mode.

Figure 21:
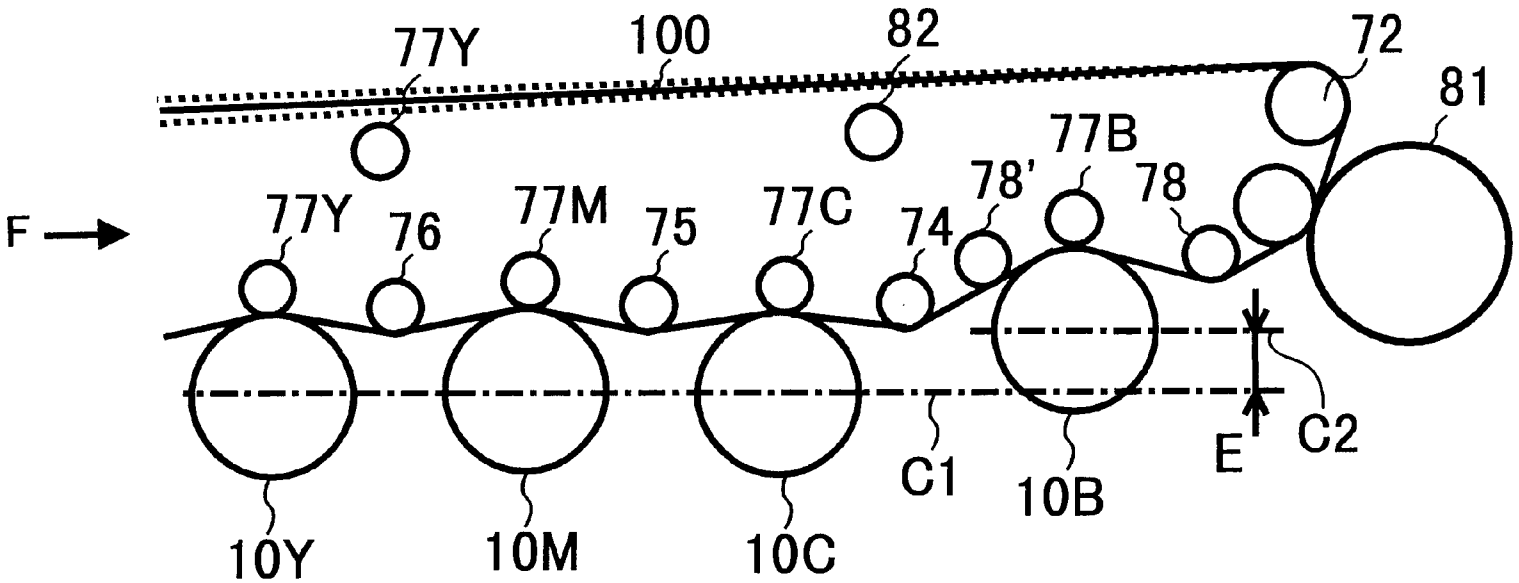
FIG. 21 explains a construction of the image forming apparatus in the multicolor mode according to another embodiment of the present invention.
Figure 22:
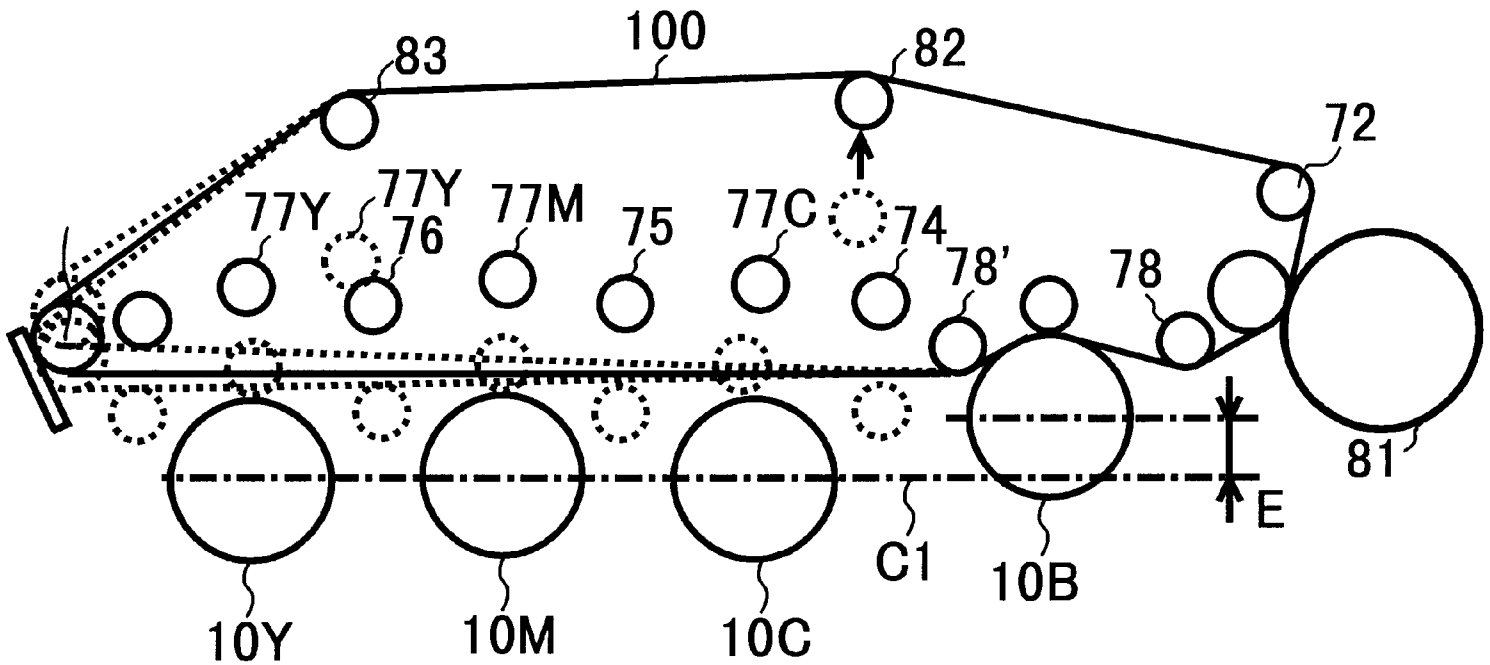
FIG. 22 explains a construction of the image forming apparatus in black color mode according to another embodiment of the present invention.
Figure 23:
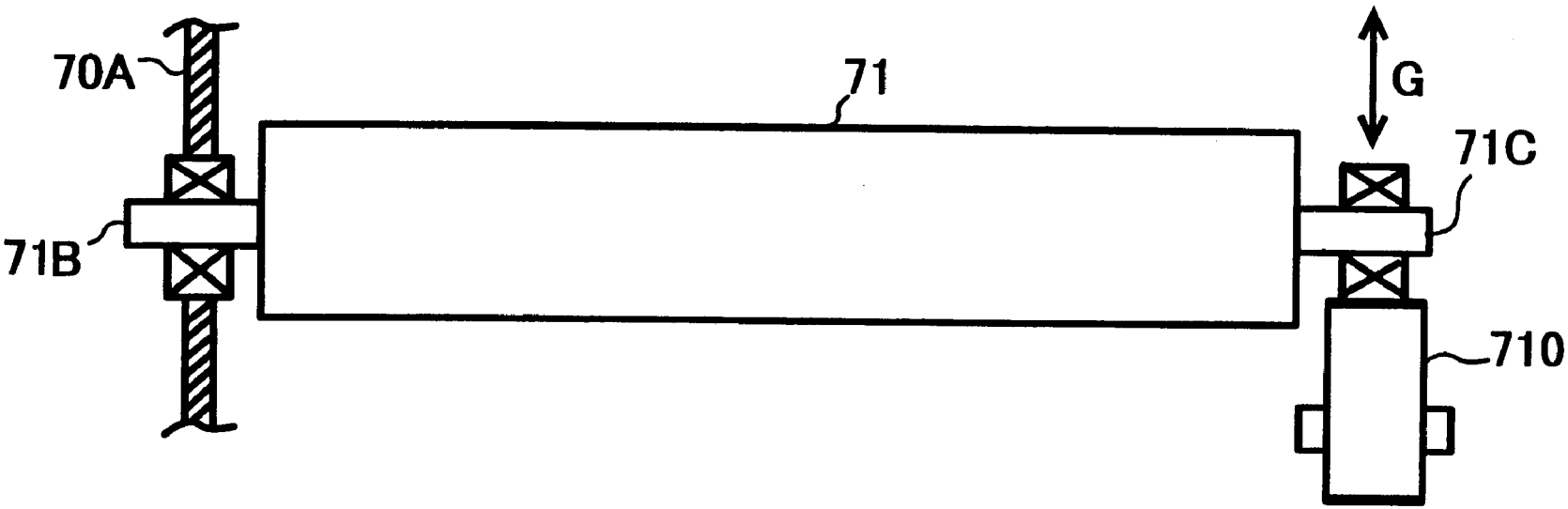
FIG. 23 is a side view of the tension roller according to another embodiment of the present invention.

As illustrated in FIGS. 21 and 22, the photoconductive element 10B for black color may be located in a different level in a direction orthogonal to the axes of photoconductive elements 10Y, 10M and 10C. To be specific, as illustrated in FIG. 21, photoconductive elements 10Y, 10M and 10C are disposed such that a center line of photoconductive elements 10Y, 10M and 10C (indicated by a chained line C1) is located further from the intermediate transfer belt 100 than a center line of the photoconductive element 10B (indicated by a chained line C2), which is in parallel with C1, by a level difference of E. As illustrated in FIG. 23, which is a view from a direction indicated by an arrow F in FIG. 21, in this configuration the tension roller 71 acts to correct shifting of the intermediate transfer belt 10 to one side. One end 71*b* of a shaft of the tension roller 71 is fixed to a housing 70*a* of the intermediate transfer unit 70 and the eccentric cam 710 abuts against the other end 71*c* of the shaft via a bearing. The end 71*c* of the shaft moves in a direction (vertical direction indicated by a double-headed arrow G) orthogonal to a direction to which a tension is applied to the intermediate transfer belt 100 so as to correct the shifting of the intermediate transfer belt 100 to a width direction.

A chained line and a two-dotted and dashed line in the proximity of the intermediate transfer belt 100 (a solid line) in FIGS. 21 and 22 illustrates edges of the intermediate transfer belt 100 when the intermediate transfer belt 100 is moved by the tension roller 71 to correct a shifting of the intermediate transfer belt 100 in the width direction.

The cleaning device 79 to clean a surface of the intermediate transfer belt 100 is configured to move integrally with the tension roller 71 (see FIG. 14). Therefore, even when the tension roller 71 changes its position to correct a shifting of balance of the intermediate transfer belt 100, the cleaning blade 79*a* and the cleaning roller 79*b* securely contact the intermediate transfer belt 100, and thereby the intermediate transfer belt 100 is kept well-cleaned.

In this configuration, when the intermediate transfer belt 100 is separated from the photoconductive elements 10Y, 10M and 10C in the black color mode, positions of the spanning rollers 78 and 78' and the primary transfer roller 77B relating to the photoconductive element 10B remain unchanged as illustrated in FIG. 22. Alternatively, spanning rollers 74, 75, 76 and 80, and primary transfer rollers 77Y, 77M and 77C relating to photoconductive elements 10Y, 10M and 10C are moved in an upward direction, separating from these photoconductive elements, by a driving mechanism (not shown). Thus, the intermediate transfer belt 100 can be separated from photoconductive elements 10Y, 10M and 10C by moving only part of the spanning rollers and primary transfer rollers.

In the above-described separation of the intermediate transfer belt from the photoconductive elements, supporting rollers 82 and 83 for applying a supplementary pressure to the intermediate transfer belt 100 (hereinafter referred to as supplementary roller) are moved in an upward direction to press an underside of the portion of the intermediate transfer belt 100 spanned between the driving roller 72 and the tension roller 71 so as to prevent the tension of the intermediate transfer belt 100 from changing (a decrease in the tension). Further, in this configuration, the tension roller 71 is not required to be moved greatly in order to suppress the change in the tension of the intermediate transfer belt 100 caused by the above-described separation of the intermediate transfer belt 100 from photoconductive elements. Therefore, the conditions of the tension of the intermediate transfer belt 100 given by the tension roller 71, and the function of the tension roller 71 to correct a shifting of the intermediate transfer belt 100 are hardly influenced by the separation of the intermediate transfer belt 100 from photoconductive elements, thus making it possible to maintain the quality of images.

As illustrated in FIG. 21, in the multicolor mode where the intermediate transfer belt 100 contacts photoconductive elements 10Y, 10M and 10C, supplementary rollers 82 and 83 are located so as to securely separate from the underside of the intermediate transfer belt 100 even when maximum shifting correction is made to the intermediate transfer belt by the tension roller 71. Consequently, in the multicolor mode, the function of the tension roller 71 to correct a shifting of the intermediate transfer belt 100 may not be affected by a contact of supplementary rollers 82 and 83 with the intermediate transfer belt 100.

In the above described embodiment of the present invention, a belt-formed member and an opposing member which contacts the belt-formed member are described as the intermediate transfer belt 100 and the photoconductive drums respectively. However, the present invention can also be applied when the belt-formed member is a photoconductive belt 300 and a plurality of opposing members, contacting the photoconductive belt 300, are developer rollers 41B, 41Y, 41M and 41C, as illustrated in FIG. 24.

Figure 24:
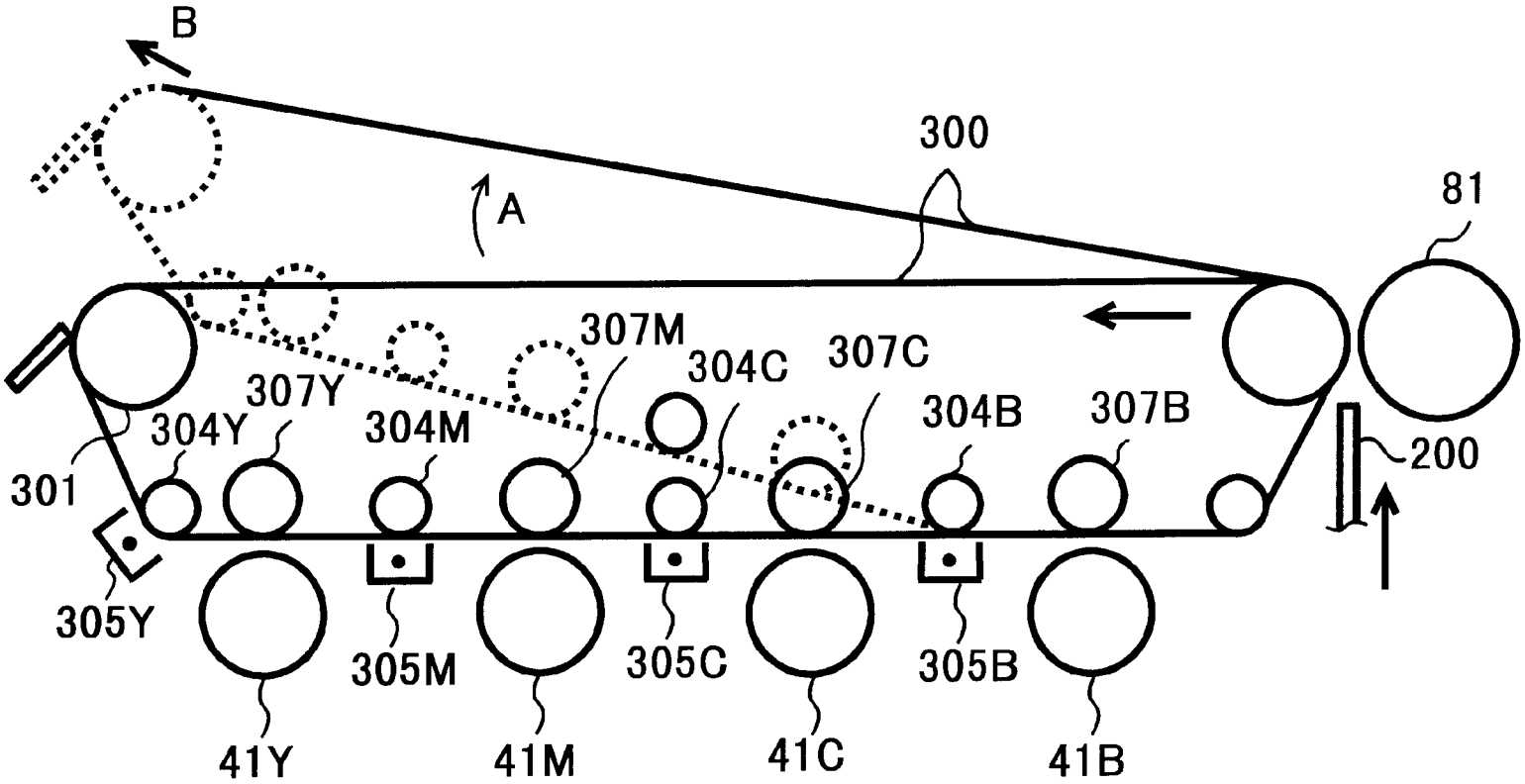
FIG. 24 is an enlarged view of a construction of the image forming apparatus according to another embodiment of the present invention.

In the image forming apparatus illustrated in FIG. 24, charging devices 305B, 305Y, 305M and 305C are disposed to oppose supporting rollers 304B, 304Y, 304M and 304C at an upstream side of respective developing rollers in the moving direction of the photoconductive belt 300. Opposing rollers 307B, 307Y, 307M and 307C are provided at positions opposed to developing rollers 41B, 41Y, 41M and 41C respectively while the photoconductive belt 300 is interposed between the opposing rollers and the developing rollers. The photoconductive belt 300 is uniformly charged by the charging devices 305B, 305Y, 305M and 305C and is exposed to laser beam lights corresponding to colors of an original image from a laser writing unit and then electrostatic latent images corresponding to respective colors are formed on the photoconductive belt 300. When a black and white image is formed in the image forming apparatus, supporting rollers 301, 304Y, 304M and 304C and opposing rollers 307Y, 307M, 307C as well as the photoconductive belt 300 are pivoted about the supporting rollers 304B located between developing rollers 41B and 41C in a direction indicated by an arrow A in FIG. 24. Then, the photoconductive belt 300 is separated from developing rollers 41Y, 41M and 41C. During the pivotal movement, the supporting roller 301, which also works as a tension roller, moves toward the outside of the apparatus as indicated by an arrow B in FIG. 24 so as to prevent a tension of the photoconductive belt 300 from decreasing, thus enabling the photoconductive belt 300 to be driven accurately even in the black and white image forming operation.

Especially, in the configuration illustrated in FIG. 24, the photoconductive belt 300 and the belt-formed member may be disposed contacting or in the vicinity of developing rollers 41B, 41Y, 41M and 41C as a plurality of opposing members (developer bearing member). The arrangement of the photoconductive belt 300 and developing rollers 41B, 41Y, 41M and 41C can be determined according to a development system such as contacting and non-contacting development systems. The present invention can be applied to both developing systems.

Figure 25:
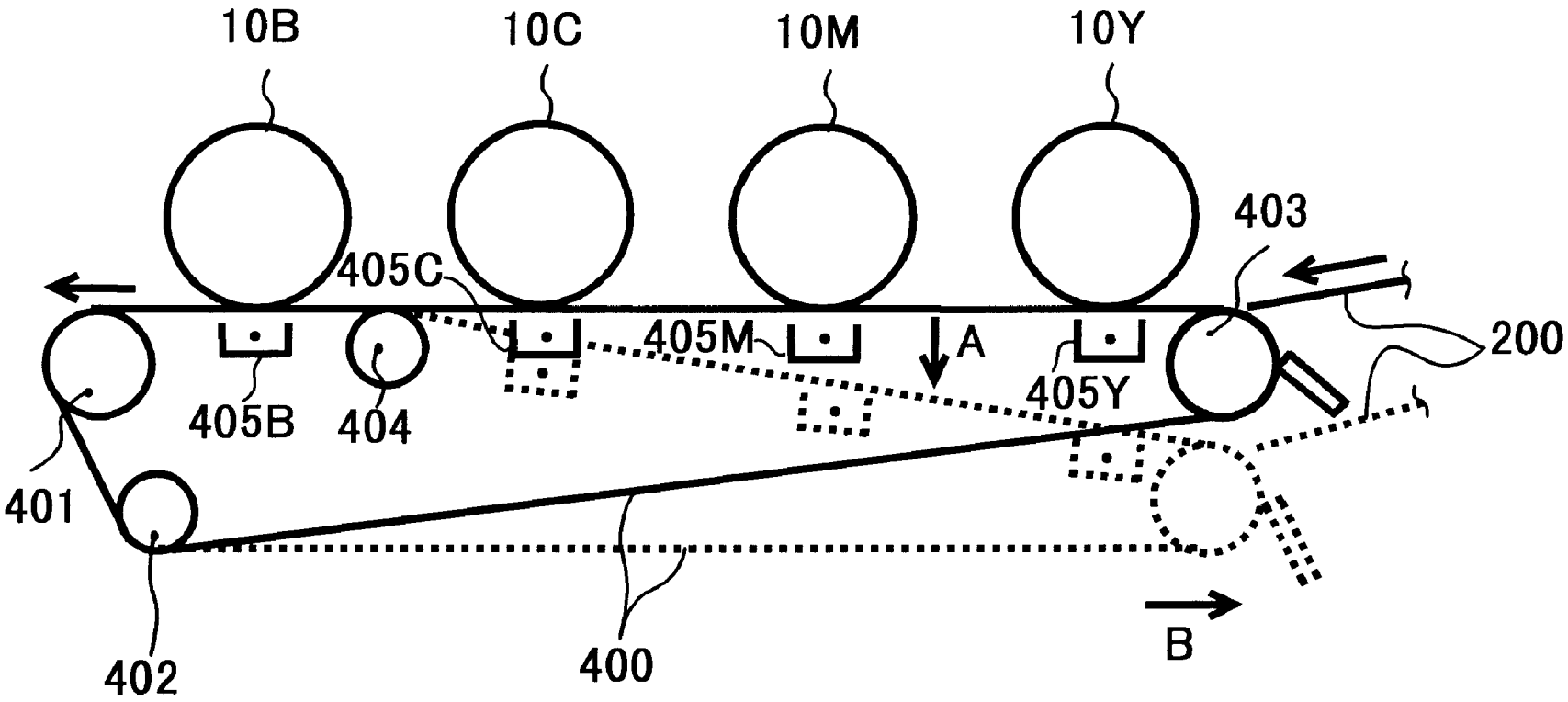
FIG. 25 is an enlarged view of a construction of the image forming apparatus according to another embodiment of the present invention.

Further, as illustrated in FIG. 25, the present invention can also be applied to an image forming apparatus configured such that a belt-formed member is a transfer sheet conveying belt 400 to convey a transfer sheet 200 to a transfer area while a plurality of opposing members opposed to the transfer sheet conveying belt 400 are photoconductive drums 10B, 10Y, 10M and 10C of respective colors. In the image forming apparatus illustrated in FIG. 25, the transfer sheet conveying belt 400 is supported by a plurality of supporting rollers 401, 402, 403 and 404 and charging devices 405B, 405Y, 405M and 405C are arranged opposing to respective photoconductive drums 10B, 10Y, 10M and 10C while interposing the transfer sheet conveying belt 400 between the charging devices and the photoconductive drums. Supporting rollers 401 and 403 serve as a belt driving roller and a tension roller respectively.

When a black and white image is formed in the image forming apparatus, the supporting roller (the tension roller) 403 as well as charging devices 405Y, 405M and 405C are pivoted about the supporting roller 404 located between photoconductive drums 10B and 10C in a direction indicated by an arrow A in FIG. 25. Thereby the transfer sheet conveying belt 400 is separated from the photoconductive drums 10Y, 10M and 10C. In the pivotal movement, the supporting roller 403, which also functions as a tension roller, is moved toward the outside of the apparatus as indicated by an arrow B to prevent a tension of the transfer sheet conveying belt 400 from decreasing, thus enabling the transfer sheet conveying belt 400 to be frictionally driven accurately even in the black and white image forming operation.

Figure 26:
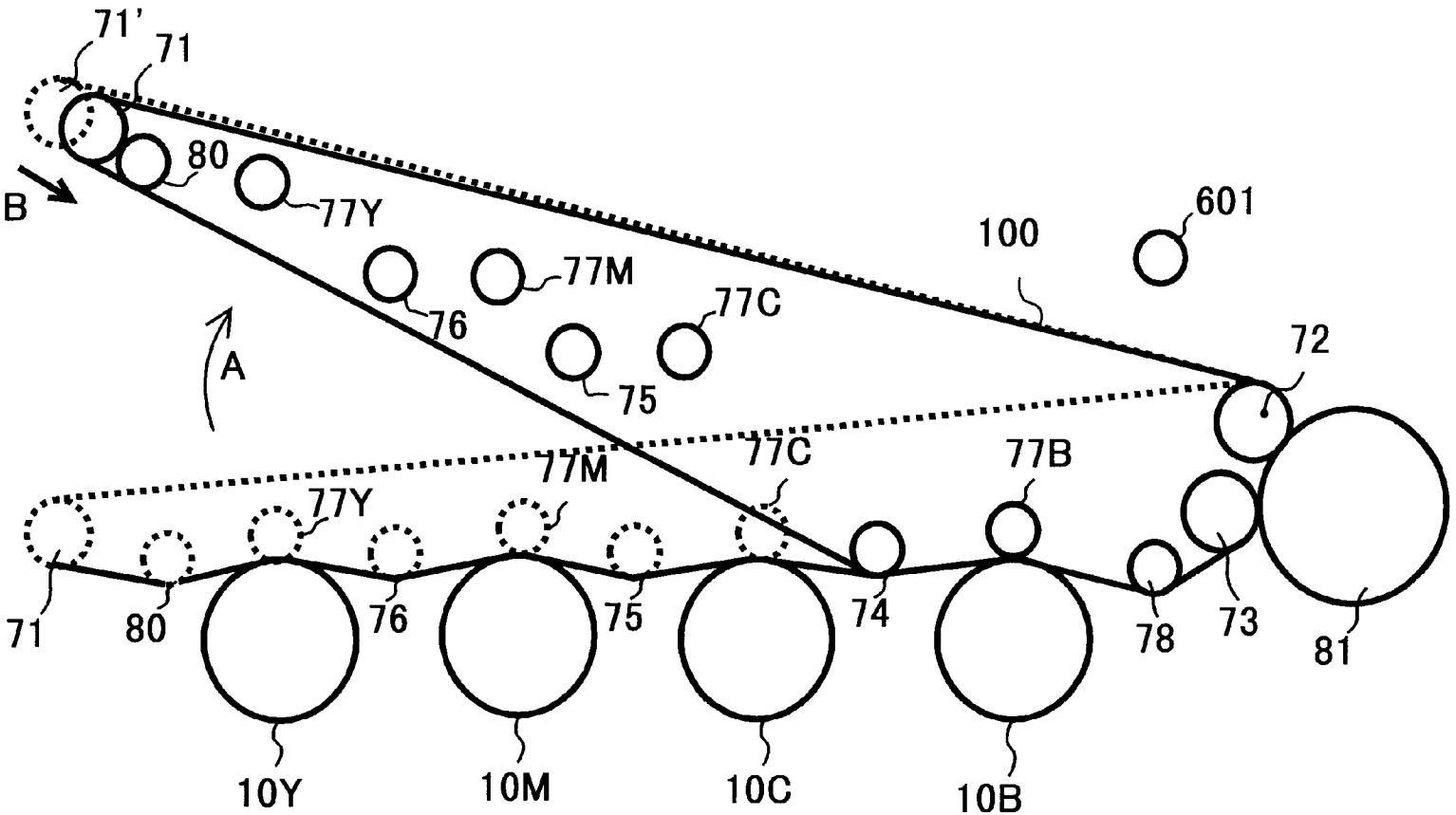
FIG. 26 is an enlarged view of a construction of the image forming apparatus according to another embodiment of the present invention.

The present invention may be also applied to an image forming apparatus configured such that a tension of a belt-formed member is increased when the belt-formed member separates from some of the opposing members as illustrated in FIG. 26. The image forming apparatus shown in FIG. 26 is configured in a manner similar to the apparatus illustrated FIG. 4, however, a pivot of a pivot subunit including part of supporting rollers 71, 75, 76 and 80 is positioned differently. In the image forming apparatus shown in FIG. 26, a pivot 601 is positioned such that a tension of the intermediate transfer belt 100 is increased in the above described pivotal movement.

When a black and white image is formed in the image forming apparatus, part of supporting rollers 77Y, 77M and 77C are pivoted about the pivot 601 in a direction indicated by an arrow A in FIG. 26. Thereby, the intermediate transfer belt 10 is separated from the photoconductive drums 10Y, 10M and 10C. During the pivotal movement, the supporting roller 71, which also functions as a tension roller, moves toward the inside of the apparatus as indicated by an arrow B in FIG. 26 to prevent the tension of the intermediate transfer belt 100 from being increased which consequently suppresses a driving load from increasing and enables the intermediate transfer belt 100 to be frictionally driven accurately even in the black and white image forming operation.

The positions of the supporting rollers designated with a dash (') in FIG. 26 indicate virtual intermediate positions of corresponding rollers when they are moved.

In the above described embodiments of the present invention, the description has been made for the image forming apparatus using high viscosity liquid developer, however, the present invention can also be applied to image forming apparatuses using dry developer or liquid developer other than the high viscosity developer.

Further, in the above-described embodiments of the present invention, a belt-formed member such as an intermediate transfer belt is described in an endless form, however, the present invention may be applied to belts other than such an endless belt and produces the same effect. For example, it can be applied to a configuration in which a belt supplied from a supplying roller is driven so as to be wound up by a winding roller. In this configuration, for example, the belt is supported by a plurality of supporting rollers with a constant tension such that a portion of the belt spanned around the reel roller and the supplying roller opposes a plurality of opposing members. A route that the belt is spanned is changed so as to separate from part of the opposing members when necessary. In the separating operation, relative distances between the supporting rollers are adjusted so as to suppress the change in the tension of the belt.

Moreover, in the above-described embodiments, the description has been made with respect to image forming apparatuses, however the present invention can be applied to a belt device including a belt-formed member supported by a plurality of supporting rollers and a plurality of opposing members which are located opposite to the belt-formed member and side by side in a line, contacting the belt-formed member or in the vicinity of the belt-formed member. According to the present invention, unnecessary contact of the opposing members with the belt-formed member is suppressed and thereby decrease of the life of the opposing member is avoided.

Obviously, numerous additional modifications and variations of the present invention are possible in light of the above teachings. It is therefore to be understood that within the scope of the appended claims, the present invention may be practiced otherwise than as specifically described herein.

What is claimed as new and is desired to be by Letters Patent of the United States is:

1. An image forming apparatus, comprising:

a belt-formed member supported by a plurality of supporting rollers, the belt-formed member being a belt-formed intermediate transfer element;

a plurality of opposing members arranged side by side in a line so as to oppose said belt-formed member and to be contacting or in close proximity to said belt-formed member, each of the plurality of opposing members being a latent image bearing member on which a latent image to be transferred onto said intermediate transfer element is formed; and a separation device configured to change a position such that said intermediate transfer element and a part of said plurality of latent image bearing members, contacting or in close proximity each other, are separated; wherein said separation device includes a switching device configured to switch in stages a number of said opposing members to be separated from said belt-formed member.

2. An image forming apparatus according to claim 1, further comprising:

a mode determination device configured to determine an image forming, mode according to image data; and a control device configured to control said separation device in accordance with the image forming mode determined by said mode determination device.

3. An image forming apparatus according to claim 1, further comprising:

an image forming mode selectable between a single color mode to form a single color image and a multicolor mode to form a multicolor image by superimposing a plurality of images of different colors on each other; and a control device configured to control said switching device according to a number of colors in said different colors when said multicolor mode is selected.

4. An image forming apparatus according to claim 1, wherein:

an image forming mode is selectable between a single color mode to form a single color image and a multicolor mode to form a multicolor image by superimposing a plurality of images of different colors on each other; and said single color mode is a black color mode.

5. An image forming apparatus according to claim 1, further comprising:

an image forming mode selectable between a single color mode to form a single color image and a multicolor mode to form a multicolor image by superimposing a plurality of images of different colors on each other; and a control device configured to control said separation device so that said opposing members used for said multicolor image formation and said belt-formed member oppose each other while image data of each of said different colors is being bit-mapped in the multicolor mode having been switched from the single color mode.

6. An image forming apparatus according to claim 1, further comprising:

a control device configured to stop mechanical devices relating to said opposing members separated from said belt-formed member.

7. An image forming apparatus, comprising:

a belt-formed member supported by a plurality of supporting rollers, the belt-formed member being a belt-formed intermediate transfer element;

a plurality of opposing members arranged side by side in a line so as to oppose said belt-formed member and to be contacting or in close proximity to said belt-formed member, each of the plurality of opposing members being a latent image bearing member on which a latent image to be transferred onto said intermediate transfer element is formed; and a separation device configured to change a position such that said intermediate transfer element and a part of said plurality of latent image bearing members, contacting or in close proximity each other, are separated; wherein:

said separation device includes a pivot mechanism configured to partly pivot said belt-formed member so as to separate said belt-formed member from a part of said opposing members; and a cleaning device configured to clean said belt-formed member and arranged at a place where said belt-formed member is not pivoted by said pivot mechanism.

8. An image forming apparatus according to claim 7, further comprising:

an image forming mode selectable between a single color mode to form a single color image and a multicolor mode to form a multicolor image by superimposing a plurality of images of different colors on each other; and a control device configured to control said cleaning device to clean said belt-formed member while image data of each of said different colors is being bit-mapped in the muilticolor mode.

9. An image forming unit device for use in an image forming apparatus in a detachable form, comprising:

an intermediate transfer element as a belt-formed member supported by a plurality of supporting rollers so as to contact or be in close proximity to a plurality of latent image bearing members opposing said intermediate transfer element; and a separation device configured to separate said intermediate transfer element contacting or in close proximity to the plurality of latent image bearing members from a part of said plurality of latent image bearing members; wherein said separation device includes a switching device configured to switch in stages a number of said opposing members to be separated from said belt-formed member.

10. An image forming apparatus, comprising:

a belt-formed member supported by a plurality of supporting rollers;

a plurality of opposing members arranged side by side in a line so as to oppose said belt-formed member and to be contacting or in close proximity to said belt-formed member; and a separation device configured to change a position such that said belt-formed member and a part of said plurality of opposing members, contacting or in close proximity each other, are separated; and a relative distance changing device configured to change a relative distance between at least one of the plurality of supporting rollers and other of the plurality of supporting rollers so as to suppress a change in a tension of said belt-formed member in said separation of said belt-formed member from a part of said plurality of opposing members.

11. An image forming apparatus according to claim 10, wherein:

said relative distance changing device increases the relative distance between at least one of the plurality of supporting rollers and other of the plurality of supporting rollers to suppress a decrease of the tension of said belt-formed member in said separation of said belt-formed member from a part of said plurality of opposing members.

12. An image forming apparatus according to claim 11, wherein:

said separation device pivots the part of said plurality of supporting rollers about a pivot located between an opposing member of the plurality of opposing members disposed at an end of the plurality of opposing members in a direction in which the plurality of opposing members are arranged and an opposing roller disposed next to said opposing member such that said belt-formed member is separated from opposing members of the plurality of opposing members other than the opposing member disposed at the end of said plurality of opposing members.

13. An image forming apparatus according to claim 11, wherein:

a part of said supporting rollers is a spanning roller to span said belt-formed member so that said belt-formed member windingly contacts each of said opposing members, and said separation device separates said belt-formed member from the part of said opposing members such that the winding contact of said belt-formed member with the part of said plurality of opposing members is temporarily released.

14. An image forming apparatus according to claim 10, wherein:

said belt-formed member is a belt-formed intermediate transfer element and said plurality of opposing members are image bearing members on which images of different colors to be transferred onto said intermediate transfer element are formed.

15. An image forming apparatus according to claim 14, further comprising:

a control device configured to stop mechanical devices relating to said opposing members separated from said belt-formed member.

16. A unit device for use in an image forming apparatus in a detachable form, comprising:

an intermediate transfer element as a belt-formed member supported by a plurality of supporting rollers so as to contact or be in close proximity to a plurality of image bearing members opposing said intermediate transfer element;

a separation device configured to separate said belt-formed member contacting or in close proximity to the plurality of image bearing members from a part of said plurality of image bearing members; and a relative distance changing device configured to change a relative distance between at least one of the plurality of supporting rollers and other of the plurality of supporting rollers so as to suppress a change in a tension of said belt-formed member in said separation of said belt-formed member from a part of said plurality of image bearing members.

* * * * *